US007737862B2

(12) United States Patent
Watanabe

(10) Patent No.: US 7,737,862 B2
(45) Date of Patent: Jun. 15, 2010

(54) REMOTE CONTROL SYSTEM AND METHOD THEREOF, REMOTE CONTROL DEVICE AND DEVICE TARGETED FOR CONTROL

(75) Inventor: Mitsuhiro Watanabe, Tokyo (JP)

(73) Assignee: NEC CORPORATION, Tokyo (JP)

( * ) Notice: Subject to any disclaimer, the term of this patent is extended or adjusted under 35 U.S.C. 154(b) by 1002 days.

(21) Appl. No.: 11/436,530

(22) Filed: May 19, 2006

(65) Prior Publication Data

US 2006/0270458 A1 Nov. 30, 2006

(30) Foreign Application Priority Data

May 20, 2005 (JP) ..... 2005-147523

(51) Int. Cl.
*G08C 19/00* (2006.01)

(52) U.S. Cl. ..... 340/825.69; 340/10.5; 340/5.61; 341/176

(58) Field of Classification Search ..... 340/825.69, 340/825.72, 5.64, 10.5, 5.61; 341/175, 176; 348/734

See application file for complete search history.

(56) References Cited

U.S. PATENT DOCUMENTS 6,133,847 A * 10/2000 Yang ..... 340/825.22

7,319,394 B2 * 1/2008 Sheller ..... 340/572.1

FOREIGN PATENT DOCUMENTS

| | | |
|---|---|---|
| JP | 9-125768 A | 5/1997 |
| JP | 2002-330483 | 11/2002 |
| JP | 2004-320209 | 11/2004 |

* cited by examiner

*Primary Examiner*—Vernal U Brown
(74) *Attorney, Agent, or Firm*—Sughrue Mion, PLLC

(57) ABSTRACT

In a remote control system, when a user directs a host device of a portable type toward target devices for search and specification, a search signal including a unique identifier (UID) is transmitted from a directional antenna. Each of the target devices stores the UID included in the received search signal in a memory unit, and transmits a response signal including device information on itself from an antenna. The host device identifies one of the target devices based on the device information included in the response signal, runs a control program for the identified target device, and displays an operation screen on a display unit. When the user instructs the remote operation on the operation screen, the host device transmits a remote control signal including the UID from the omni-directional antenna. When the target device receives the remote control signal including the UID that matches with the UID stored in the memory unit, the target device controls a function unit according to the remote control signal.

21 Claims, 12 Drawing Sheets

REMOTE CONTROL SYSTEM AND METHOD THEREOF, REMOTE CONTROL DEVICE AND DEVICE TARGETED FOR CONTROL

FIELD OF THE INVENTION

The present invention relates to a remote control system using a wireless signal. More specifically, the invention relates to a system in which using one remote control device and the wireless signal, one of controlled target devices is selectively remote-controlled.

BACKGROUND OF THE INVENTION

An example of a conventional remote control system of this type is described in Patent Document 1. In this remote control system described in Patent Document 1, two antennas composed by directional and omni-directional antennas are provided for a remote control device. Assume that, in order to perform remote control of a certain controlled target device, a user determines an orientation of the remote control device so that the desired certain controlled target device is identified in a direction in which sensitivity of the directional antenna becomes best and that the user presses a remote control key. Then, the remote control device transmits a signal requesting connection through the omni-directional antenna, performs switching to the directional antenna, and waits for a response. Each controlled target device that has received the signal requesting connection transmits a response signal including device attribute information on itself. Response signals transmitted from devices other than the controlled target device identified in the direction in which the sensitivity of the directional antenna becomes best cannot be received at the remote control device, or a reception level of the remote control device becomes low even if the response signals can be received. Utilizing this, the remote control device specifies one controlled target device as a current target for control. When a plurality of effective responses is present, a list of controlled target devices from which the responses have been present is displayed to cause the user to select the controlled target device. The one controlled target device is thereby specified for the current target for control. Next, a program for performing remote control of the specified controlled target device is run to display an operation screen on a display unit, and switching to the omni-directional antenna is performed again. Thereafter, the remote control device transmits to the controlled target device a remote control signal corresponding to an operation instructed by the user through the operation screen, from the omni-directional antenna.

Other example of the conventional remote control system is described in Patent Document 2. In this remote control system described in Patent Document 2, an arrangement status of controlled target devices, which are present around the system, is displayed on a display screen of a remote control device, using icons. In response to an operation instruction for an icon, a remote control signal specifying an identifier (a device ID) set in advance in one of the devices corresponding to the icon is transmitted to the one of the devices.

[Patent Document 1]

Japanese Patent Kokai Publication No. JP-P2002-330483A

[Patent Document 2]

Japanese Patent Kokai Publication No. JP-P2004-320209A

SUMMARY OF THE DISCLOSURE

According to a conventional technique described in Patent Document 1, a remote operation on a plurality of controlled target devices can be performed by using one remote control device. Further, a device desired to be remote-controlled can be selected from among the controlled target devices by an intuitive operation of directing the remote control device toward the controlled target device, desired to be selected and depressing the remote control key of the remote control device. Further, after the controlled target device has been selected, the remote control signal is transmitted from the omni-directional antenna. Accordingly, there is an advantage that during the remote operation, the user does not need to direct the remote control device to the controlled target device. However, the following problem arises.

It is necessary to frequently perform switching between the antennas in the remote control device. The reason for this is that, after a request for connection has been transmitted through the omni-directional antenna, the response therefor is received through the directional antenna, and switching to the omni-directional antenna is performed after the controlled target device has been specified.

There may occur such a case that an unexpected other device among the controlled target devices is remote-controlled. The reason for this is that though a signal generated by a certain remote control program should generally operate only a certain specific controlled target device associated with the program, there is no guarantee that the signal will never operate any types of devices of any device manufacturers. In order to improve this problem, it is arranged that the identifier (device ID) set in the device in advance is included in the remote control signal, and only the device having the same identifier receives the remote control signal, as shown in Patent Document 2. Since there is no organization for assigning an identifier unified to all devices, it is impossible to assign the unique identifier to all devices of all device manufacturers, in advance. Further, even if the unique identifier could be assigned to the all devices of the all device manufacturers in advance, the identifier will become data with the extremely large number of bits. It is wasteful to include the identifier in the remote control signal, for transmission.

Accordingly, it is an object of the present invention to provide a remote control system which can reduce the frequency of antenna switching, and which can avoid an unexpected other device from being remote-controlled.

The above and other objects are attained by a first remote control system according to the present invention, comprising a remote control device and one or more controlled target devices, wherein the remote control device includes:

an antenna unit for being switched between a directional antenna and an omni-directional antenna;

a wireless communication unit connected to the antenna unit;

a user input/output unit;

a target search unit, responsive to a target search instruction input from the user input/output unit, for transmitting a search signal including a unique identifier through the wireless communication unit with the antenna unit switched to the directional antenna, associating the identifier assigned by the remote control device with device information received from one of the one or more controlled target devices, for storage in a control target information memory unit, based on a response signal including the identifier and the device information received at the wireless communication unit, and for identifying the one of the one or more controlled target devices based on the stored information; and a target control unit for transmitting a remote control signal including the identifier, for remote controlling the identified one of the one or more devices, through the wireless communication unit with the antenna unit switched to said omni-directional antenna, and wherein each of the one or more controlled target devices includes:

an antenna;

a wireless communication unit connected to the antenna;

a device information memory unit for storing device information on the each of the one or more controlled target devices;

an identifier memory unit for storing an identifier assigned to the each of the one or more controlled target devices;

a search response unit for storing the identifier included in the search signal in the identifier memory unit when the search signal transmitted from the remote control device is received by the wireless communication unit, and transmitting the response signal including the identifier and the device information stored in the device information memory unit to the remote control device through the wireless communication unit; and a function control unit for comparing the identifier included in the remote control signal with the identifier stored in the identifier memory unit when the remote control signal transmitted from the remote control device is received by the wireless communication unit, and executing processing specified by the remote control signal when coincidence of the identifiers is detected.

In a second remote control system according to the present invention, the remote control device as defined in the first remote control system, includes:

a target separating unit for transmitting an identifier reassignment signal a newly generated identifier and the device information included in the response signal to each of a plurality of the one or more controlled target devices except one controlled target device, to perform identifier reassignment when the response signal to the search signal transmitted from the target search unit is transmitted from each of the plurality of the one or more controlled target devices, displaying on the user input/output unit a list of the plurality of the one or more controlled target devices with different identifiers respectively assigned thereto, and for identifying one of the plurality of the one or more controlled target devices by an input from the user input/output unit; and the each of the one or more controlled target devices, as defined in the first second remote control system, includes an identifier rewriting unit for comparing the device information included in the identifier reassignment signal with the device information stored in the device information memory unit when the identifier reassignment signal transmitted from the remote control device is received by the wireless communication unit, and updating the identifier memory unit with the new identifier included in the identifier reassignment signal when coincidence of the device information is detected.

In a third remote control system according to the present invention, the remote control device, as defined in the first second remote control system, includes:

a target narrowing-down unit for displaying on the user input/output unit a list of a plurality of the one or more controlled target devices each having transmitted the response signal when the response signal to the search signal transmitted from the target search unit is transmitted from the each of the plurality of the one or more controlled target devices, locating one of the plurality of the one or more controlled target devices by an input from the user input/output unit, and transmitting an identifier reassignment signal including a newly generated identifier and the device information included in the response signal to the identified one of the plurality of the one or more controlled target devices, thereby performing identifier reassignment; and the each of the one or more controlled target devices, as defined in the first second remote control system, includes an identifier rewriting unit for comparing the device information included in the identifier reassignment signal with the device information stored in the device information memory unit when the identifier reassignment signal transmitted from the remote control device is received by the wireless communication unit, and for updating the identifier memory unit with the new identifier included in the identifier reassignment signal when coincidence of the device information is detected.

In a fourth remote control system according to the present invention, the antenna unit as defined in any one of the first, second, and third remote control systems, includes directional antenna, omni-directional antenna and an antenna switching unit for performing switching connection between the directional antenna and the wireless communication unit and connection between the omni-directional antenna and the wireless communication unit.

In a fifth remote control system according to the present invention, the antenna unit as defined in any one of the first, second, and third remote control systems, includes:

an array antenna capable of performing switching of antenna characteristics between antenna characteristics comparable to antenna characteristics of the directional antenna and antenna characteristics comparable to antenna characteristics of the omni-directional antenna; and a directivity switching unit for switching the antenna characteristics of the array antenna.

In a sixth remote control system according to the present invention, transmission of the remote control signal to the one or more controlled target devices from the remote control device as defined in ant one of the first, second, and third remote control systems, using the omni-directional antenna is performed through a wireless relay station.

A first remote control method according to the present invention is the method of remote controlling controlled target devices using a remote control device, wherein the remote control device includes an antenna unit for being switched between a directional antenna and an omni-directional antenna, a wireless communication unit connected to the antenna unit, a user input/output unit, and a control target information memory unit and each of the controlled target devices includes an antenna, a wireless communication unit connected to the antenna, a control target information memory unit, a device information memory unit for storing device information on the each of the controlled target devices, and an identifier memory unit for storing an identifier assigned to the each of the controlled target devices. The method comprises the steps of:

responsive to a target search instruction input from the user input/output unit, transmitting a search signal including the unique identifier through the wireless communication unit with the antenna unit switched to the directional antenna, by a target search unit of the remote control device;

storing the identifier included in the search signal in the identifier memory unit and transmitting a response signal including the identifier and the device information stored in the device information memory unit to the remote control device through the wireless communication unit, by a search response unit of each of the controlled target devices that have received the search signal;

associating the identifier with the device information for each of the controlled target devices, for storage in the control target information memory unit, locating one of the controlled target devices, by the target search unit of the remote control device, based on the response signal including the identifier and the device information, received at the wireless communication unit of the remote control device;

transmitting a remote control signal including the identifier, for remote controlling the identified one of the controlled target devices, through the wireless communication unit of the remote control device with the antenna unit switched to the omni-directional antenna, by a target control unit of the remote control device; and comparing the identifier included in the remote control signal with the identifier stored in the identifier memory unit and executing processing specified by the remote control signal when coincidence of the identifiers is detected, by a function control unit of the identified one of the controlled target devices that has received the remote control signal.

A second remote control method according to the present invention is the method of remote controlling controlled target devices using a remote control device, wherein the remote control device includes an antenna unit for being switched between a directional antenna and an omni-directional antenna, a wireless communication unit connected to the antenna unit, and a user input/output unit, and each of the controlled target devices includes an antenna, a wireless communication unit connected to the antenna, a device information memory unit for storing device information on the each of the controlled target devices, and an identifier memory unit for storing an identifier assigned to the each of the controlled target devices. The method comprises the steps of:

responsive to a target search instruction input from the user input/output unit, transmitting a search signal including the unique identifier through the wireless communication unit of the remote control device with the antenna unit switched to the directional antenna, by a target search unit of the remote control device;

storing the identifier included in the search signal in the identifier memory unit and transmitting a response signal including the identifier and the device information stored in the device information memory unit to the remote control device through the wireless communication unit, by a search response unit of each of the controlled target devices that have received the search signal;

transmitting an identifier reassignment signal including a newly generated identifier and the device information included in the response signal to each of a plurality of the controlled target devices except one controlled target device, by a target separating unit of the remote control device, when the response signal to the search signal transmitted from the target search unit is transmitted from the each of the plurality of the controlled target devices;

comparing the device information included in the identifier reassignment signal with the device information stored in the device information memory unit and for updating the identifier memory unit with the new identifier included in the identifier reassignment signal when coincidence of the device information is detected, by an identifier rewriting unit of each of the plurality of the controlled target devices that have received the identifier reassignment signal;

displaying on the user input/output unit a list of the plurality of the controlled target devices with different identifiers assigned thereto and locating one of the plurality of the controlled target devices by an input from the user input/output unit, by the target separating unit of the remote control device;

transmitting a remote control signal including the identifier, for remote controlling the identified one of the plurality of the controlled target devices, through the wireless communication unit of the remote control device with the antenna unit switched to the omni-directional antenna, by a target control unit of the remote control device; and comparing the identifier included in the remote control signal with the identifier stored in the identifier memory unit and executing processing specified by the remote control signal, when coincidence of the identifiers is detected, by a function control unit of the identified one of the plurality of the controlled target devices that has received the remote control signal.

A third remote control method according to the present invention is the method of remote controlling controlled target devices using a remote control device, wherein the remote control device includes an antenna unit for being switched between a directional antenna and an omni-directional antenna, a wireless communication unit connected to the antenna unit, and a user input/output unit, and each of the controlled target devices includes an antenna, a wireless communication unit connected to the antenna, a device information memory unit for storing device information on the each of the controlled target devices, and an identifier memory unit for storing an identifier assigned to the each of the controlled target devices. The method comprises the steps of:

responsive to a target search instruction input from the user input/output unit, transmitting a search signal including the unique identifier through the wireless communication unit of the remote control device with the antenna unit switched to the directional antenna, by a target search unit of the remote control device;

storing the identifier included in the search signal in the identifier memory unit and transmitting a response signal including the identifier and the device information stored in the device information memory unit to the remote control device through the wireless communication unit, by a search response unit of each of the controlled target devices that have received the search signal;

displaying on the user input/output unit a list of a plurality of the controlled target devices each having transmitted the response signal when the response signal to the search signal transmitted from the target search unit is transmitted from each of the plurality of the controlled target devices, locating one of the plurality of the controlled target devices by an input from the user input/output unit, and for transmitting an identifier reassignment signal including a newly generated identifier and the device information included in the response signal toward the identified one of the plurality of the controlled target devices, by a target narrowing-down unit of the remote control device;

comparing the device information included in the identifier reassignment signal with the device information stored in the device information memory unit and updating the identifier memory unit with the new identifier included in the identifier reassignment signal when coincidence of the device information is detected, by an identifier rewriting unit of each of the plurality of the controlled target devices that have received the identifier reassignment signal;

transmitting a remote control signal including the reassigned identifier, for remote controlling the identified one of the plurality of the controlled target devices, through the wireless communication unit of the remote control device with the antenna unit switched to the omni-directional antenna, by a target control unit of the remote control device; and comparing the identifier included in the remote control signal with the identifier stored in the identifier memory unit and executing processing specified by the remote control signal when coincidence of the identifiers is detected, by a function control unit of the identified one of the plurality of the controlled target devices that has received the remote control signal.

A first remote control device according to the present invention includes:

an antenna unit for being switched between a directional antenna and an omni-directional antenna;

a wireless communication unit connected to the antenna unit;

a user input/output unit;

a control target information memory unit;

a target search unit responsive to a target search instruction input from the user input/output unit for transmitting a search signal including a unique identifier to controlled target devices through the wireless communication unit with the antenna unit switched to the directional antenna, associating the identifier with device information for each of the controlled target devices, for storage in the control target information memory unit, based on a response signal including the identifier and the device information received at the wireless communication unit, and locating one of the controlled target devices based on the stored information; and a target control unit for transmitting a remote control signal including the identifier, for remote controlling the identified one of the devices, through the wireless communication unit with the antenna unit switched to the omni-directional antenna.

A second remote control device according to the present invention is the first remote control device further including:

a target separating unit for transmitting an identifier reassignment signal a newly generated identifier and the device information included in the response signal to each of a plurality of the controlled target devices except one controlled target device, to perform identifier reassignment, when the response signal to the search signal transmitted from the target search unit is transmitted from each of the plurality of the controlled target devices, displaying on the user input/output unit a list of the plurality of the controlled target devices with different identifiers assigned thereto, and locating one of the plurality of the controlled target devices by an input from the user input/output unit.

A third remote control device according to the present invention is the first remote control device further including:

a target narrowing-down unit for displaying on the user input/output unit a list of a plurality of the controlled target devices each having transmitted the response signal when the response signal to the search signal transmitted from the target search unit is transmitted from each of the plurality of the controlled target devices, locating one of the controlled target devices by an input from the user input/output unit, and transmitting an identifier reassignment signal including a newly generated identifier and the device information included in the response signal to the identified one of the controlled target devices, thereby performing identifier reassignment.

A first controlled target device according to the present invention includes:

an antenna;

a wireless communication unit connected to the antenna;

a device information memory unit for storing device information on the controlled target device;

an identifier memory unit for storing an identifier assigned to the controlled target device;

a search response unit for storing the unique identifier included in a search signal in the identifier memory unit, when the search signal including the unique identifier transmitted from a remote control device is received by the wireless communication unit, and for transmitting a response signal including the identifier and the device information stored in the device information memory unit to the remote control device through the wireless communication unit; and a function control unit for comparing the identifier included in the remote control signal with the identifier stored in the identifier memory unit when the remote control signal transmitted from the remote control device is received by the wireless communication unit, and for executing processing specified by the remote control signal when coincidence of the identifiers is detected.

A second controlled target device according to the present invention includes:

an identifier rewriting unit for comparing device information included in an identifier reassignment signal with the device information stored in the device information memory unit when the identifier reassignment signal including a reassigned identifier and the device information transmitted from the remote control device is received by the wireless communication unit, and updating the identifier memory unit with the reassigned identifier included in the identifier reassignment signal when coincidence of the device information is detected.

In the present invention, when a user inputs the target search instruction from the input unit of the remote control device, the antenna unit is switched to the directional antenna, so that the search signal including the unique identifier is transmitted to an outside through the wireless communication unit. Accordingly, this search signal is readily received by a controlled target device that is present in a direction in which an electric wave of the directional antenna is emitted. Reception of the search signal becomes difficult in a controlled target device in a direction other than the direction in which the electric wave is emitted. In the controlled target device that has received the search signal, after the identifier included in the search signal has been stored in the identifier memory unit, the response signal including device information on itself is wirelessly transmitted to the remote control device. In the remote control device, based on this device information in the response signal, the controlled target device is identified. If response signals have been returned from a plurality of controlled target devices, identifier reassignment is performed so that, to at least one of the plurality of devices selected by the user, a unique identifier different from identifiers of the remaining controlled target devices is assigned. After the unique identifier has been assigned to the specific controlled target device and then the user operates the input unit of the remote control device to instruct a certain remote operation, the remote control signal including the identifier is transmitted wirelessly from the remote control device with the antenna unit switched to the omni-directional antenna. Then, only when the identifier included in the remote control signal matches with the identifier stored in the identifier memory unit of the controlled target device that has received this remote control signal, the processing specified by the remote control signal is executed.

The meritorious effects of the present invention are summarized as follows.

According to the present invention, a remote operation on a plurality of controlled target devices can be performed by using one remote control device. Further, by using the directional antenna, a controlled target device that is present in a direction specified by the user can be intuitively selected. Further, after the controlled target device has been selected, the remote control signal is transmitted through the omni-directional antenna. Thus, there is no need for directing the remote control device toward the controlled target device during the remote operation.

Further, according to the present invention, after the search signal has been transmitted through the directional antenna, switching to the omni-directional antenna is performed to transmit the remote control signal. Thus, the frequency with which antenna switching is performed in the remote control device can be reduced.

According to the present invention, when the remote control device selects the controlled target device, the unique identifier is dynamically assigned. When the remote operation is performed, the remote control device includes the assigned identifier in the remote control signal, for transmission. Then, in the controlled target device that has received the remote control signal, the identifier assigned to itself is compared with the identifier included in the remote control signal, and only when coincidence of the identifiers is detected, the processing specified by the remote control signal is executed. Accordingly, an occurrence wherein an unexpected other controlled target device may be remote-controlled can be suppressed.

Further, according to the present invention, the dynamically assigned identifier does not need to allow unique identification of all devices of all manufacturers. Thus, the number of bits of the identifier does not need to be large. For this reason, a data length of the remote control signal itself can be correspondingly reduced. Thus, an efficiency of using the electric wave and an efficiency of using a memory for storing the identifier can be improved.

Still other features and advantages of the present invention will become readily apparent to those skilled in this art from the following detailed description in conjunction with the accompanying drawings wherein only the preferred embodiments of the invention are shown and described, simply by way of illustration of the best mode contemplated of carrying out this invention. As will be realized, the invention is capable of other and different embodiments, and its several details are capable of modifications in various obvious respects, all without departing from the invention. Accordingly, the drawing and description are to be regarded as illustrative in nature, and not as restrictive.

PREFERRED EMBODIMENTS OF THE INVENTION

Next, embodiments of the present invention will be described in detail with reference to drawings.

First Embodiment

Figure 1:
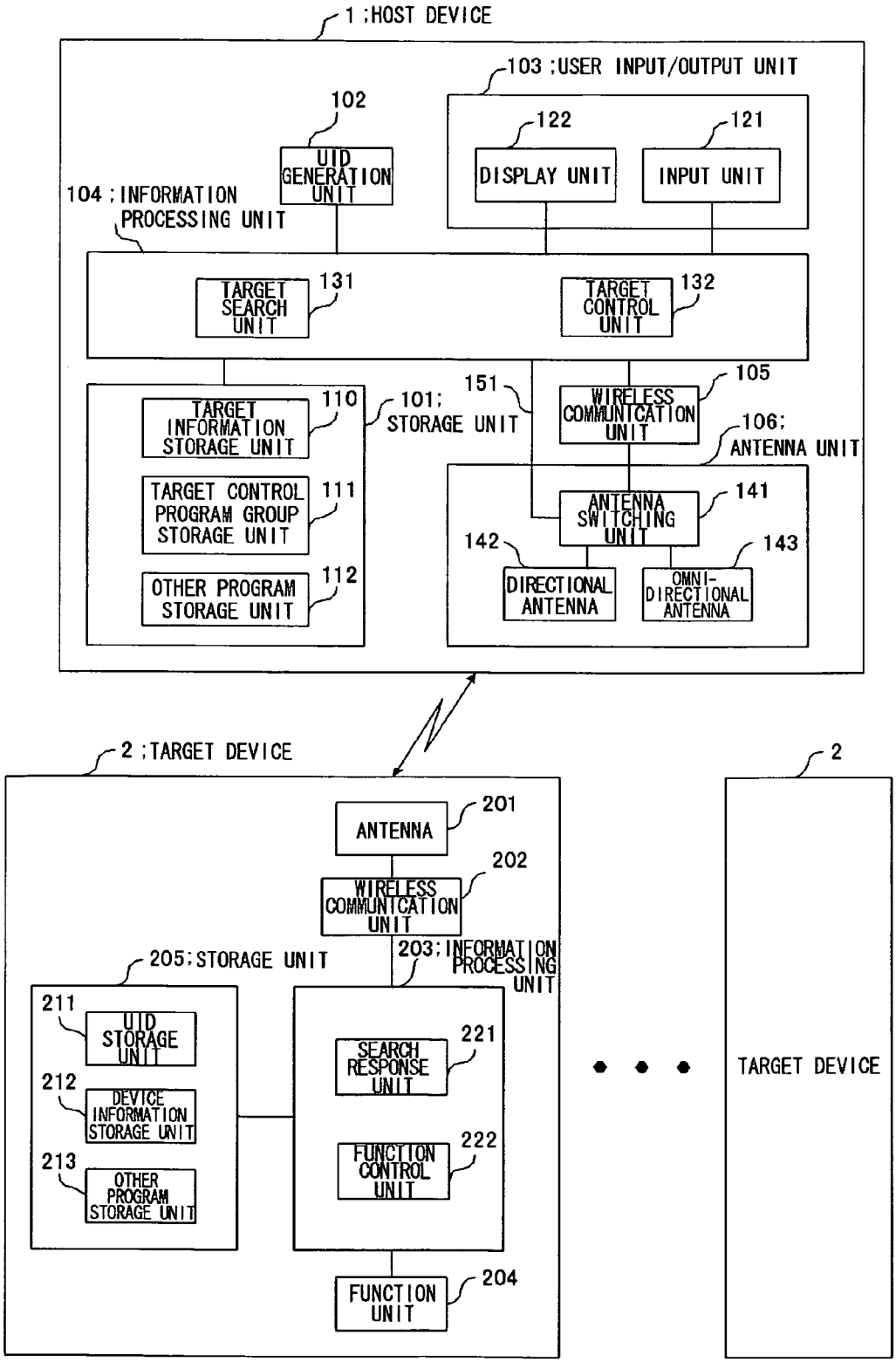
FIG. 1 is a block diagram showing a first embodiment of the present invention.

Referring to FIG. 1, a remote control system according to a first embodiment of the present invention includes a host device 1 that is a remote control device and a plurality of target devices 2 that are controlled target devices.

The host device 1 comprises a memory unit 101, a UID (Unique Identity) generation unit 102, a user input/output unit 103, an information processing unit 104, a wireless communication unit 105, and an antenna unit 106. The memory unit 101 includes a target control program group memory unit 111 and other program memory unit 112. The user input/output unit 103 includes an input unit 121 and a display unit 122. The information processing unit 104 includes a target search unit 131 and a target control unit 132. The antenna unit 106 includes an antenna switching unit 141, a directional antenna 142, and an omni-directional antenna 143.

The directional antenna 142 is the antenna of which antenna sensitivity in a certain specific direction is markedly higher than antenna sensitivity in other direction. A directional antenna as shown in Patent Document 1, for example, or other directional antennas of various modes can be employed as the directional antenna 142. The omni-directional antenna 143 is the antenna of which antenna sensitivity in all directions in a certain plane is equal. When an antenna switching signal 151 sent from the information processing unit 104 commands switching to the directional antenna, the antenna switching unit 141 electrically connects the directional antenna 142 of the directional antenna 142 and the omni-directional antenna 143 to the wireless communication unit 105. When the antenna switching signal 151 commands switching to the omni-directional antenna, the antenna switching unit 141 electrically connects the omni-directional antenna 143 to the wireless communication unit 105. The wireless communication unit 105 performs transmission and reception of a wireless signal with a target device 2 through the antenna unit 106.

The input unit 121 comprises an input device such as a keyboard or the like. The display unit 122 comprises a display device such as an LCD. The user input/output unit 103, which is a man machine interface (MMI: Man Machine Interface) comprises the input unit 121 and the display unit 122.

The UID generation unit 102 generates a unique identifier which is dynamically assigned to a target device 2. The UID generation unit 102 comprises a counter, a random number generator, and the like, for example. Since the identifier does not need to enable unique identification of all devices of all manufacturers, and since consideration should be given to devices connected in a local network, the identifier may be constituted from a small number of bits.

The memory unit 101 comprises a main memory or an external memory device of a computer, for example. A target information memory unit 110 of the memory unit 101 associates a UID assigned to the target device 2 by the host device 1 with device information received from the target device 2 and stores the UID. The target control program group memory unit 111 stores a control program for a target device 2, corresponding to the device information on the target device 2, in advance. The other program memory unit 112 stores a program to be executed by the information processing unit 104 and a result of processing of the program.

The information processing unit 104 is composed by a central processing unit of the computer, for example. The information processing unit 104, in the present embodiment, includes the target search unit 131 for selecting a target device, which is targeted for control, from among one or more target devices 2 that are present around the host device 1 and the target control unit 132 for remote controlling the target device 2 selected by the target search unit 131.

Responsive to a target search instruction input from the user input/output unit 103, the target search unit 131 switches the antenna unit 106 to the directional antenna 142. The target search unit 131 transmits a search signal including the unique identifier generated by the UID generation unit 102 and a search command to the one or more target devices 2 through the wireless communication unit 105. Based on each of response signals including the identifier and device information received at the wireless communication unit 105, the target search unit 131 associates the identifier with the device information for each of the target devices 2, stores the associated information in the target information memory unit 110, and identifies the controlled target device, based on the stored information.

The target control unit 132 searches for the control program which is for remote controlling the target device 2 which has been identified as the controlled target device by the target search unit 131 from the target control program group memory unit 111 using the device information included in the response signal as a search key, for execution. The target control unit 132 thereby causes the host device 1 to function as the remote control device for the identified target device 2. Specifically, an operation screen of the target device 2 is displayed on the display unit 122. Then, when a remote operation on the target device 2 is instructed by an operation through the input/output unit 121, the target control unit 132 transmits a remote control signal including the identifier assigned to the target device 2 to the target device 2 through the wireless communication unit 105 with the antenna unit 106 switched to the omni-directional antenna 143.

On the other hand, each target device 2 comprises an antenna 201, a wireless communication unit 202, an information processing unit 203, a function unit 204, and a memory unit 205. The memory unit 205 includes a UID memory unit 211, a device information memory unit 212, and an other program memory unit 213. The information processing unit 203 includes a search response unit 221 and a function control unit 222.

The function unit 204 is a portion for implementing an original function of the target device 2, and a configuration thereof differs according to the type of the target device 2. When the target device 2 is a TV receiver, for example, the function unit 204 includes all devices and functions necessary for the TV receiver. When the target device 2 is a video recorder, the function unit 204 includes all devices and functions necessary for the video recorder.

The antenna 201 is the omni-directional antenna. The wireless communication unit 202 performs transmission and reception of the wireless signal with the host device 1 through the antenna 201.

The memory unit 205 comprises a main memory or an external memory unit of a computer constituting the target device 2, for example. The UID memory unit 211 in the memory unit 205 holds the unique identifier assigned from the host device 1 to the target device so that it can be rewritten. The device information memory unit 212 stores the device information indicating the type of the target device. The device information is constituted from a manufacturer's code, a device type code, a device model number, and the like, for example. The other program memory unit 213 stores a program to be executed by the information processing unit 203 and a result of processing of this program.

The information processing unit 203 is composed by a central processing unit of the computer, for example. The information processing unit 203 in the present embodiment includes the search response unit 221 for processing the search signal transmitted from the host device 1 and the function control unit 222 for processing the remote control signal transmitted from the host device 1.

The search response unit 221 receives from the wireless communication unit 202 the search signal received from the host device 1, stores the identifier included in the search signal in the UID memory unit 211, and sends the response signal including the identifier and the device information stored in the device information memory unit 212 to the host device 1 through the wireless communication unit 202.

The function control unit 222 receives from the wireless communication unit 202 the remote control signal received from the host device 1, compares the identifier included in the remote control signal with the identifier stored in the UID memory unit 211, and executes processing indicated by the remote control signal on the function unit 204 only when coincidence of the identifiers is obtained.

Figure 2:
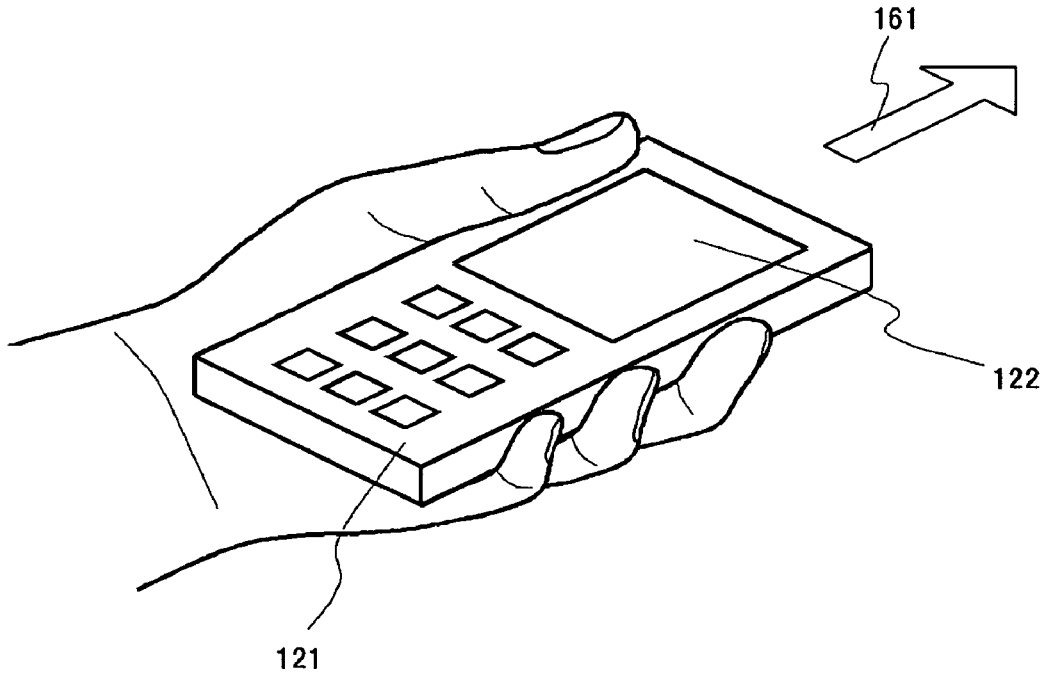
FIG. 2 is a view showing an outward appearance of a host device and a state where a user grips the host device.

FIG. 2 is a view showing an outward appearance of the host device 1 and a state where a user grips the host device 1. Since the host device 1 is the remote control device used when a target device 2 is remote-controlled, the host device 1 is made small and lightweight so that the host device 1 is handy for being carried, as shown in FIG. 2. The display unit 122 is placed on the upper portion of the upper surface of the host device 1, and the input unit 121 is placed on the lower portion of the upper surface. Thus, an input operation can be performed with a right hand while carrying the host device 1 with a left hand and seeing display of the display unit 122, for example. Antenna sensitivity of the directional antenna 142 in a direction of an arrow 161 proceeding from the lower portion of the upper surface of the host device 1 to the upper portion becomes higher than that in other direction.

Next, an operation in the present embodiment when the user uses the host device 1 and selectively remote controls one of a plurality of the target devices 2 will be described with reference to FIG. 3.

Figure 3:
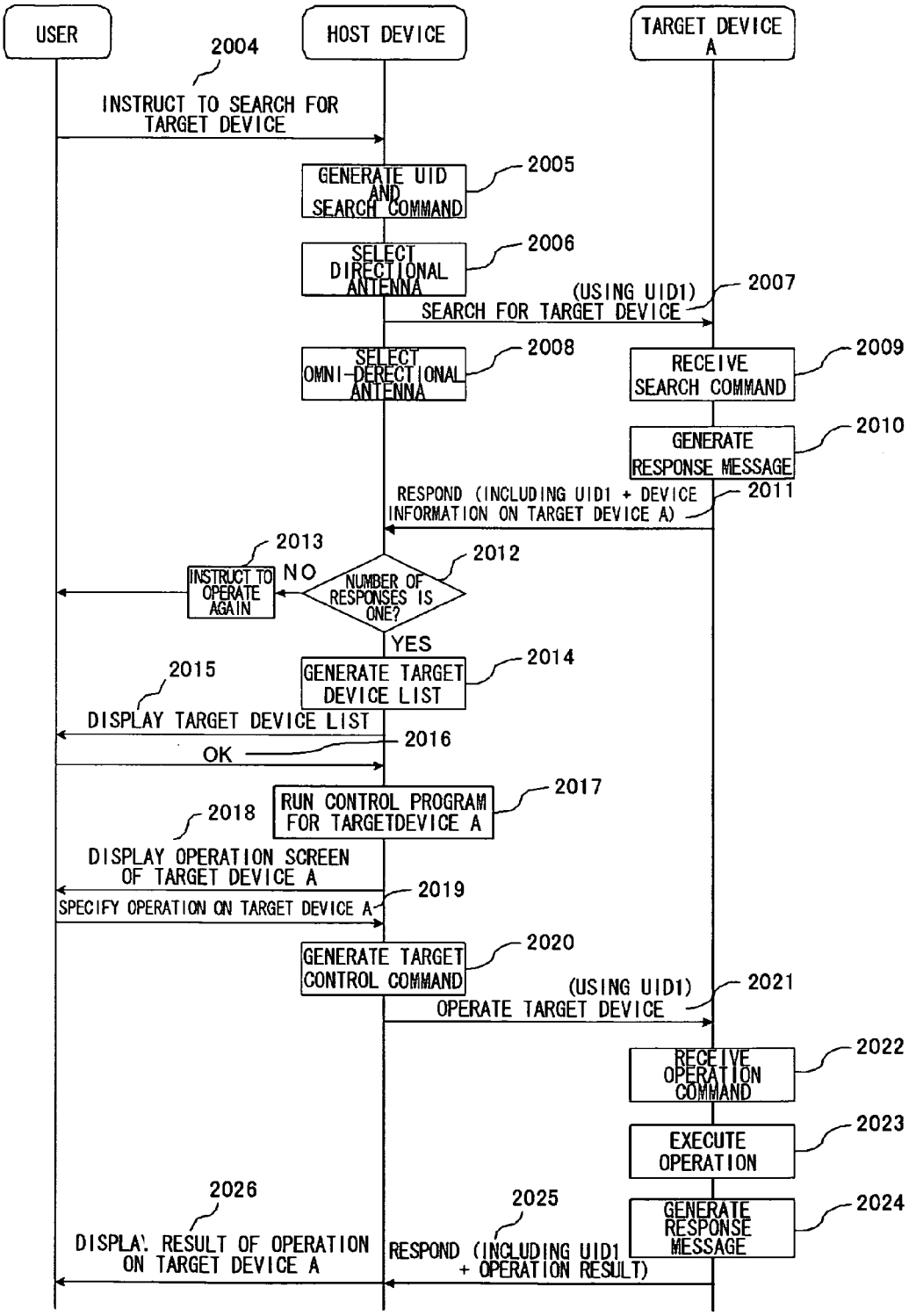
FIG. 3 is a diagram showing an operation sequence in the first embodiment of the present invention.

When the user remote controls a certain target device A among the target devices 2 that are present around him, he first grips the host device 1 as shown in FIG. 2, directs the direction of the arrow 161 toward the target device 2 desired to be remote-controlled, operates the input unit 121, and inputs an instruction for searching for the target device (at step 2004 in FIG. 3).

When the instruction for searching for the target device is input from the input unit 121, the target search unit 131 of the information processing unit 104 in the host device 1 activates the UID generation unit 102 to generate one unique identifier UID1 and also generates a search command by itself (at step 2005). Then, the target search unit 131 switches the antenna switching signal to indicate the directional antenna 142 (at step 2006), and emits the target device search signal including the generated identifier UID1 and the generated search command from the directional antenna 142 through the wireless communication unit 105 (at step 2007). Since the directional antenna 142 has directivity, reception of the target device search signal is performed with good sensitivity by the target device 2 identified in the direction of the arrow 161 in FIG. 2. However, reception of the target device search signal is not performed by the target devices 2 identified in directions other than the direction, or reception sensitivities thereof become deteriorated. When transmission of the target device search signal is completed, the target search unit 131 switches the antenna switching signal 151 to indicate the omni-directional antenna 143 (at step 2008), and waits for a response message to the target device search signal.

In the target device 2 that has received the target device search signal, the target device search signal received at the antenna 201 is sent to the information processing unit 203 through the wireless communication unit 202 and given to the search response unit 221 (at step 2009). The search response unit 221 stores the identifier UID1 included in the target device search signal in the UID memory unit 211, reads out the device information from the device information memory unit 212, generates the response message including the readout device information and the identifier UID1 (at step 2010), and transmits the response message to the host device 1 through the wireless communication unit 202 (at step 2011).

The response message transmitted from the target device 2 is received by the wireless communication unit 105 through the omni-directional antenna 143 and given to the target search unit 131 of the information processing unit 104. The target search unit 131 confirms that the identifier UID1 included in the received response message matches with the identifier included in the target device search signal and increments the number of target devices that have responded just by one. Then, after a predetermined time of the wait, the target search unit 131 determines whether the number of the target devices that have responded is one or not (at step 2012). When there is no response or when two or more target devices have responded, the target search unit 131 displays a message indicating that "selection of the target device has failed. Please perform the operation again so that only one desired target device is selected" on the display unit 122 (at step 2013), and prompts the user to perform the operation again. On the other hand, when the number of the target devices that have responded is one, the target search unit 131 generates a list of the target devices including all or part of the device information included in the response message (at step 2014) and displays the list on the display unit 122 (at step 2015). The user sees this display. Then, when the desired target device has been selected, the user inputs acceptance from the input unit 121 (at step 2016). When the target device other than the desired target device has been selected, the user performs the operation again from step 2004. When the acceptance of the display of the target device list is input from the user, the target search unit 131 transmits the device information on and the identifier UID1 for the selected target device to the target control unit 132. Incidentally, steps 2014 to 2016 may be omitted.

The target control unit 132 reads out the target control program from the target control program group memory unit 111 using the transmitted device information as the search key, and runs the readout target control program (at step 2017). That is, execution of the target control program is started by the target control unit 132. This causes an operation screen of the target device to be displayed on the display unit 122 (at step 2018). When the selected target device 2 is the TV receiver, for example, a soft key for performing channel selecting operation, a soft key for volume adjustment, and the like are displayed on the display unit 122. By operating the corresponding key on the input unit 121, a remote operation on the target device 2 becomes possible.

When the user specifies an operation on the target device 2 through the operation on the input unit 121 (at step 2019), the target control unit 132 generates a target control command corresponding to the specified operation (at step 2020), and transmits a target device operation signal including the generated command and the identifier UID1 to the target device 2 from the wireless communication unit 105 and through the omni-directional antenna 143 (at step 2021).

In the target device 2 that has received the target device operation signal, the target device operation signal received at the antenna 201 is sent to the information processing unit 203 through the wireless communication unit 202 and is given to the function control unit 222 (at step 2022). The function control unit 222 compares the identifier UID1 included in the target device operation signal with the identifier stored in the UID memory unit 211, and executes the operation specified by the target device operation signal on the function unit 204 only when coincidence of the identifiers is detected (at step 2023). Then, after completion of the operation, the function control unit 222 generates a response message including the result of the operation and the identifier UID1 (at step 2024) and transmits the response message to the host device 1 through the wireless communication unit 202 (at step 2025).

Upon reception of the response message through the wireless communication unit 105, the target control unit 132 of the host device 1 confirms that the identifier UID1 included therein matches with the identifier assigned to the device currently targeted for control, and displays the result of the operation included in the response message on the display unit 122 (at step 2026).

The user can use the host device 1 and can selectively perform remote operation of one target device among the target devices 2 in a manner described above.

Next, formats of the target device search signal, response message signal, and target device operation signal to be used in the present embodiment will be described.

Figure 4:
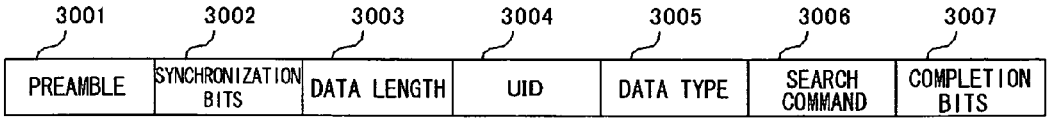
FIG. 4 is a diagram showing an example of a format of a target device search signal.

Referring to FIG. 4, an example of a format of the target device search signal is constituted from a preamble 3001, synchronization bits 3002, a data length 3003, a UID 3004, a data type 3005, a search command 3006, and completion bits 3007, each of which is constituted from the predetermined number of bits. The preamble 3001 operates as bits for starting data transmission. The synchronization bits 3002 are the bits for adjusting a timing when transmitted data is received. The data length 3003 indicates the number of bits summing the numbers of the bits of the UID 3004, data type 3005, and search command 3006. The UID 3004 is the identifier uniquely assigned to a target device 2. The data type 3005 indicates that following data is a command or the data. The search command 3006 is the command for checking presence of the target device 2. The completion bits 3007 indicate completion of the target device search signal.

Figure 5:
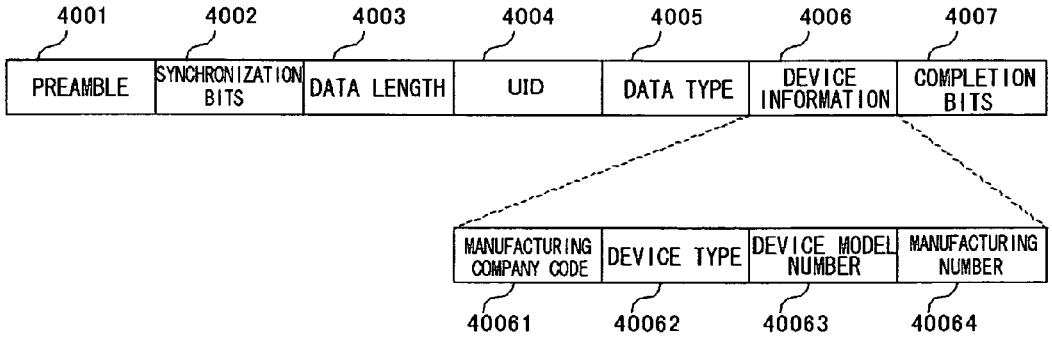
FIG. 5 is a diagram showing an example of a format of a response message signal.

Referring to FIG. 5, an example of a format of the response message signal to be used when a target device responds to the target device search signal is constituted from a preamble 4001, synchronization bits 4002, a data length 4003, a UID 4004, a data type 4005, device information 4006, and completion bits 4007, each of which other than the device information 4006 is constituted from the predetermined number of bits. The preamble 4001, synchronization bits 4002, data length 4003, UID 4004, data type 4005, and completion bits 4007 are the same as those described with reference to FIG. 4. The device information stored in the device information memory unit 212 of the target device 2 is set in the device information 4006. In the example in FIG. 5, the device information 4006 is constituted from a manufacturing company code 40061, a device type 40062, a device model number 40063, and a manufacturing number 40064. The manufacturing company code 40061 is the code for determining the company that manufactured the target device 2. The device type 40062 is the code for determining the type of the target device 2 such as a video or a TV set. The device model number

40063 is the model number of the target device 2. These become keys when the host device 1 hierarchically searches for the target control program from the target control program group memory unit 111. The manufacturing number 40064 is a serial number assigned to each target device 2. Since the device information 4006 may be the information capable of only selecting the target control program required for operating the target device 2 by the host device 1, absence of the manufacturing number 40064, for example, poses no problem in some cases.

Figure 6:
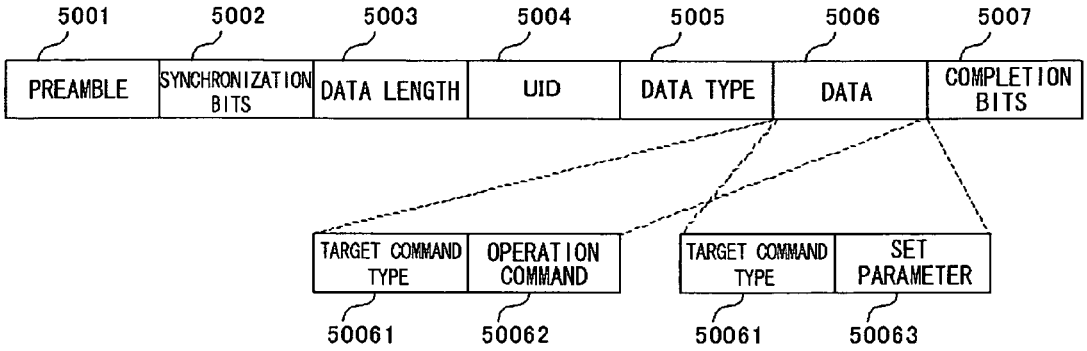
FIG. 6 is a diagram showing an example of a format of a target device operation signal.

Referring to FIG. 6, an example of a format of the target device operation signal is constituted from a preamble 5001, synchronization bits 5002, a data length 5003, a UID 5004, a data type 5005, data 5006, and completion bits 5007, each of which other than the data 5006 is constituted from the predetermined number of bits. The preamble 5001, synchronization bits 5002, data length 5003, UID 5004, data type 5005, and completion bits 5007 are the same as those described with reference to FIG. 4. The data 5006 is constituted from a command 50062 for operating the target device 2 or a parameter 50063 to be set in the target device 2, and a target command type 50061 indicating whether following data is which one of the operation command 50062 and the set parameter 50063. An operation command and a set parameter output from the target control program run by the host device 1 are set in the operation command 50062 and the set parameter 50063, respectively.

As described above, according to the present embodiment, a remote operation on a plurality of the target devices 2 can be performed using one host device 1. Further, the device desired to be remote-controlled can be selected from among the target devices 2 by an intuitive operation in which the host device 1 is operated with the directional antenna 142 being directed to the target device 2 desired to be selected. Further, after the target device 2 has been selected, the remote control signal is transmitted from the omni-directional antenna 143. Thus, an effect that the user does not need to direct the host device 1 to the target device 2 during the remote operation can be obtained. In addition, the following effect can be obtained.

A frequency of performing switching between the antennas in the host device 1 can be reduced. The reason for this is that after the target device search signal has been transmitted through the directional antenna, switching to the omni-directional antenna is performed, and reception of the response signal to the target device search signal and transmission of the remote control signal to the target device 2 are performed.

An unexpected other target device 2 may well be prohibited from being remote-controlled. The reason for this is as follows: when the host device 1 selects a target device 2, a unique identifier is dynamically assigned. When remote control is performed, the assigned identifier is included in the remote control signal and is transmitted from the host device 1. The target device 2 that has received the remote control signal compares the identifier assigned to the target device 2 with the identifier in the remote control signal, and executes processing specified by the remote control signal only when coincidence of the identifiers is detected.

Since the number of bits of the unique identifier assigned to the target device 2 does not need to be large, the data length of the remote control signal itself is correspondingly reduced. An efficiency of using an electric wave is thereby improved. The reason for this is that the dynamically assigned identifier does not need to allow unique identification of all devices of all manufacturers.

Next, a variation example of the present embodiment will be described.

After transmitting the target device search signal through the directional antenna 142, the host device 1 in the present embodiment switches the directional antenna 142 to the omni-directional antenna 143 and then receives the response signal from the target device 2. The switching from the directional antenna 142 to the omni-directional antenna 143 may be performed after the response signal has been received from the target device 2, and the response signal from the target device 2 may be received through the directional antenna 142.

Second Embodiment

Figure 7:
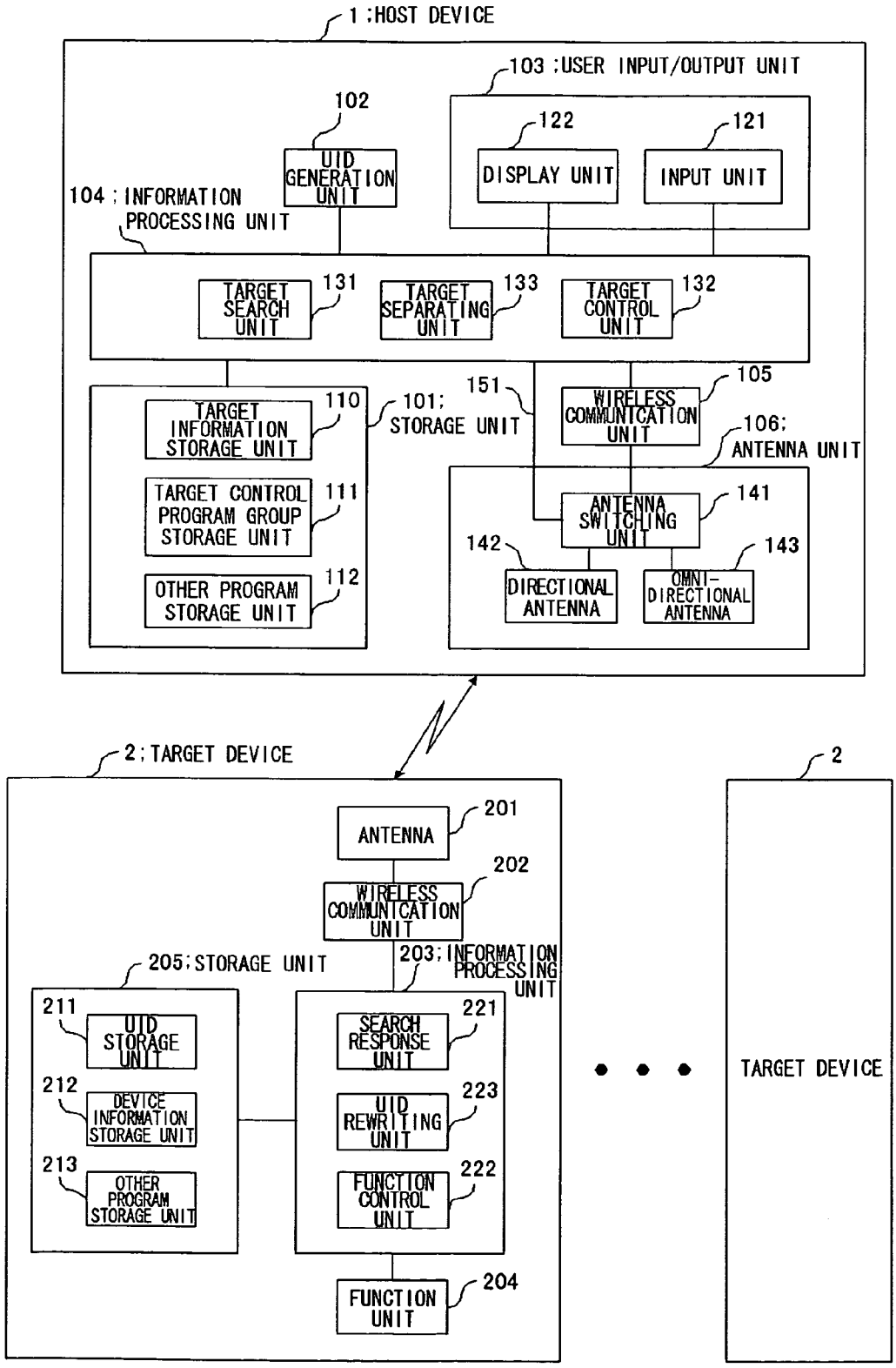
FIG. 7 is a block diagram showing a second embodiment of the present invention.

Referring to FIG. 7, a remote control system according to a second embodiment of the present invention is different from the remote control system in the first embodiment in following respects. In this system, the information processing unit 104 of the host device 1 includes a target separating unit 133. The information processing unit 203 of each target device 2 includes a UID rewriting unit 223. Then, when a target device 2 is searched for by the host device 1 using the directional antenna 142 and when response signals are then returned from a plurality of the target devices 2, UID reassignment is performed so that different UIDs are assigned to the plurality of the target devices 2, respectively. Then, one of the plurality of the target devices is selected by the user.

When the response signals to the target device search signal transmitted from the target search unit 131 are returned from the plurality of the target devices 2, the target separating unit 133 takes over processing from the target search unit 131. First, identifier reassignment signals including newly generated unique identifiers and device information included in the response signals, respectively are sequentially transmitted to all the remaining target devices excluding one target device 2 among the plurality of the target devices 2 from which the response signals have been returned, thereby performing identifier reassignment. Next, a list of the plurality of the target devices 2 to which the different identifiers have been assigned, respectively, is displayed on the display unit 122. Then, one target device 2 is selected by the user using an input from the input unit 121. The target control unit 132 performs the same processing as that in the first embodiment on the selected target device 2.

The UID rewriting unit 223 of the information processing unit 203 of each target device 2 receives an identifier reassignment signal from the host device 1 received at the wireless communication unit 202. The UID rewriting unit 223 compares device information included in this identifier reassignment signal with the device information stored in the device information memory unit 212. When the device information included in this identifier reassignment signal matches with the device information stored in the device information memory unit 212, the identifier stored in the UID memory unit 211 is overwritten by the new identifier included in the identifier reassignment signal.

Next, an operation in the present embodiment when the user selectively performs remote operation of one of the target devices 2 using the host device 1 will be described with reference to FIG. 8.

Figure 8:
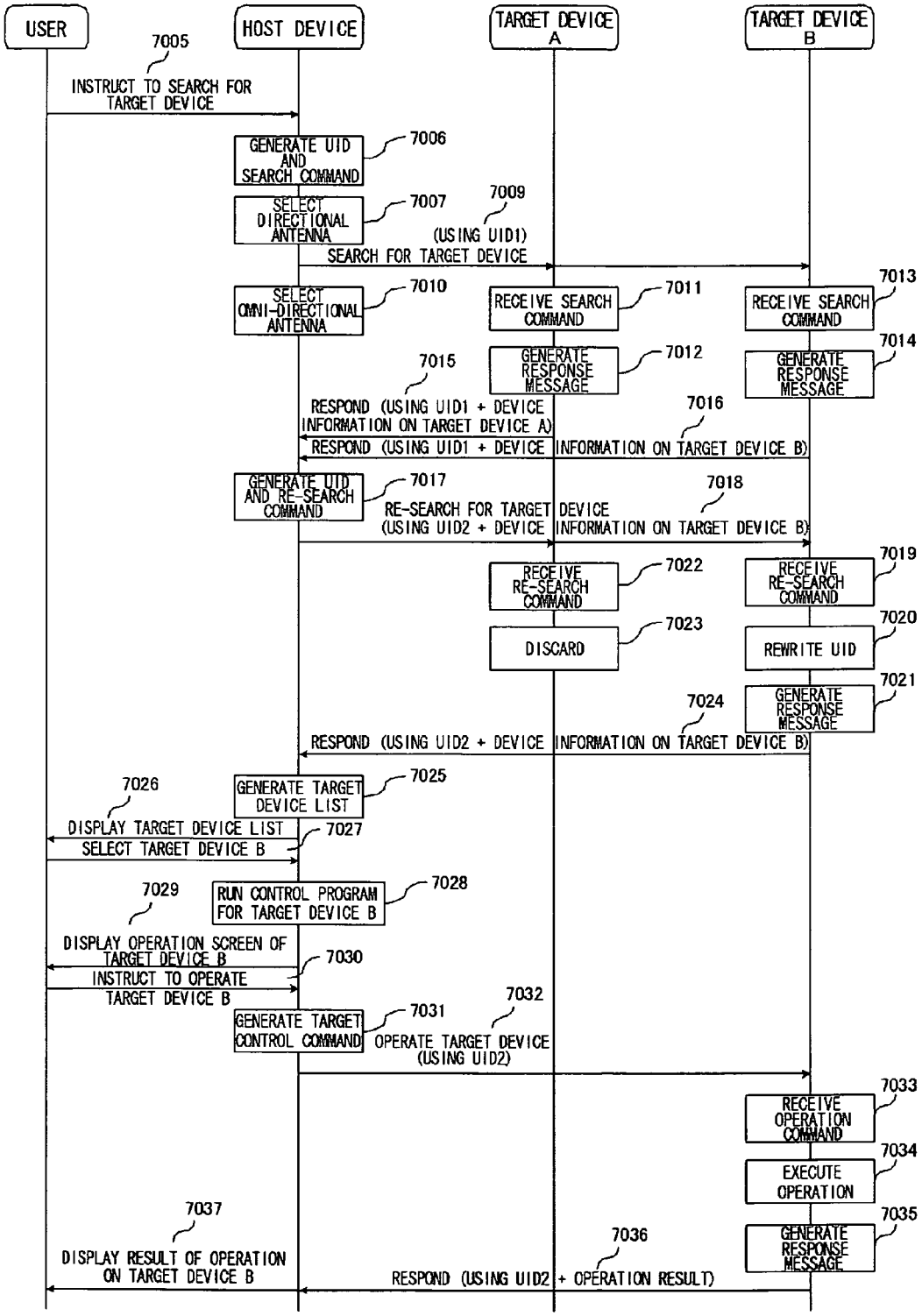
FIG. 8 is a diagram showing an operation sequence in the second embodiment of the present invention.

When the user remote operates a certain target device 2 among the plurality of the target devices 2 around him, the user first grips the host device 1 as shown in FIG. 2, directs the direction of the arrow 161 toward the target device 2 desired to be selected, and then inputs an instruction for searching for the target device by operating the input unit 121 (at step 7005 in FIG. 8).

When the instruction for searching for the target device is input from the input unit 121, the target search unit 131 in the information processing unit 104 of the host device 1 activates the UID generation unit 102, thereby generating one unique identifier UID1, and also generates the search command by itself (at step 7006). Then, the target search unit 131 switches the antenna switching signal 151 to indicate the directional antenna 142 (at step 7007), and emits the target device search signal including the generated identifier UID1 and the search command from the directional antenna 142 through the wireless communication unit 105 (at step 7009). Since the directional antenna 142 has directivity, reception of the target device search signal with good sensitivity is performed by the target device 2 identified in the direction of the arrow 161 in FIG. 2. However, reception of the target device search signal is not performed by the target devices 2 identified in directions other than the direction, or reception sensitivities thereof become deteriorated. It is assumed that in a current case, the two target devices 2 constituted from a target device A and a target device B are present in the direction of the arrow 161 and that the target device search signal is received by these two target devices 2.

When transmission of the target device search signal is completed, the target search unit 131 switches the antenna switching signal 151 to indicate the omni-directional antenna 143 (at step 7010), and waits for a response message to the target device search signal.

In the target device A that has received the target device search signal, the target device search signal received at the antenna 201 is sent to the information processing unit 203 through the wireless communication unit 202 and is given to the search response unit 221 (at step 7011). The search response unit 221 stores the identifier UID1 included in the target device search signal in the UID memory unit 211, reads out the device information from the device information memory unit 212, generates the response message including the readout device information and the identifier UID1 (at step 7012), and transmits the response message to the host device 1 through the wireless communication unit 202 (at step 7015). In the target device B as well which has received the target device search signal, as in the target device A, the target device search signal received at the antenna 201 is given to the search response unit 221 of the information processing unit 203 through the wireless communication unit 202 (at step 7013). The search response unit 221 stores the identifier UID1 included in the target device search signal in the UID memory unit 211, reads out the device information from the device information memory unit 212, generates the response message including the readout device information and the identifier UID1 (at step 7014), and transmits the response message to the host device 1 through the wireless communication unit 202 (at step 7016).

The response message transmitted from the target device A is received by the wireless communication unit 105 through the omni-directional antenna 143 and is given to the target search unit 131 of the information processing unit 104. The target search unit 131 confirms that the identifier UID1 included in the received response message matches with the identifier included in the target device search signal and increments the number of target devices that have responded just by one. Likewise, the response message transmitted from the target device B is received by the wireless communication unit 105 through the omni-directional antenna 143 and is given to the target search unit 131 of the information processing unit 104. The target search unit 131 confirms that the identifier UID1 included in the received response message matches with the identifier included in the target device search signal and increments the number of target devices that have responded just by one. In the current case, the number of the target devices that have responded finally becomes two. For this reason, the target search unit 131 gives the received response messages to the target separating unit 133, and asks the processing.

When the target separating unit 133 takes over the processing from the target search unit 131, the target separating unit 133 performs unique identifier reassignment for one of the target device A and the target device B, such as the target device B excluding the target device A, for example. That is, the target separating unit 133 generates a new identifier UID2 by the UID generation unit 102 and also generates a re-search command by itself (at step 7017). The target separating unit 133 emits the identifier reassignment signal including the generated identifier UID2, device information on the target device B, and the re-search command from the omni-directional antenna 143 through the wireless communication unit 105 (at step 7018).

In the target device B that has received the identifier reassignment signal, the identifier reassignment signal received at the antenna 201 is sent to the information processing unit 203 through the wireless communication unit 202 and is given to the UID rewriting unit 223 (at step 7019). Since the device information included in the identifier reassignment signal matches with the device information on the target device B stored in the device information memory unit 212, the UID rewriting unit 223 updates the UID memory unit 211 with the UID2 included in the identifier reassignment signal (at step 7020). Then, the target device B generates the response message including the reassigned UID2 and the device information on the target device B (at step 7021), and transmits the response message to the host device 1 through the wireless communication unit 202 (at step 7022). On the other hand, in the target device A that has received the identifier reassignment signal, the identifier reassignment signal received at the antenna 201 is given to the UID rewriting unit 223 of the information processing unit 203 through the wireless communication unit 202 (at step 7022). Then, incoincidence of the device information included in the identifier reassignment signal and the device information on the target device A stored in the device information memory unit 212 is detected by the UID rewriting unit 223, so that the identifier reassignment signal is discarded (at step 7023). As a result, the UID1 is kept assigned to the target device A, and the UID2 is reassigned to the target device B in place of the UID1.

Then, the target separating unit 133 generates a list of the target devices including all or part of the device information included in the response message (at step 7025), and displays the list on the display unit 122 (at step 7026). The user selects one target device 2 currently desired to be operated from the list by an operation on the input unit 121 (at step 7027). It is assumed that in the current case, the user has selected the target device B. When the target device B is selected from the target device list, the target search unit 131 transmits the device information on and the identifier UID2 of the selected target device to the target control unit 132.

The target control unit 132 reads out the target control program from the target control program group memory unit 111 using the transmitted device information as the search key, and runs the readout target control program (at step 7028). This displays an operation screen of the target device B on the display unit 122 (at step 7029). When the user specifies an operation on the target device B by an operation on the input unit 121 (at step 7030), the target control unit 132 generates the target control command corresponding to the specified operation (at step 7031), and transmits the target device operation signal including the generated command and the identifier UID2 to the target device 2 through the omni-directional antenna 143 from the wireless communication unit 105 (at step 7032).

In the target device B that has received the target device operation signal, the target device operation signal received at the antenna 201 is sent to the information processing unit 203 through the wireless communication unit 202 and is given to the function control unit 222 (at step 7033). Since the identifier UID2 included in the target device operation signal matches with the identifier UID2 stored in the UID memory unit 211, the function control unit 222 executes the operation specified by the target device operation signal on the function unit 204 (at step 7034). Then, after completion of the operation, the function control unit 222 generates the response message including the result of the operation and the identifier UID2 (at step 7035), and transmits the response message to the host device 1 through the wireless communication unit 202 (at step 7036).

Upon reception of the response message through the wireless communication unit 105, the target control unit 132 of the host device 1 confirms that the identifier UID2 included therein matches with the identifier assigned to the device currently targeted for control, and displays the result of the operation included in the response message on the display unit 122 (at step 7037).

Though not shown in FIG. 8, when the input unit 121 is operated to display the target device list on the display unit 122 again and the target device A is selected, the same processing as the processing after step 7028 is executed on the target device A. This makes it possible to remote operate the target device A as well.

In a manner described above, the user can use the host device 1 to allow selective remote operation of one of a plurality of the target devices 2.

In the foregoing description about the operation, a case where the two target devices 2 have responded to the target device search signal transmitted from the directional antenna 142 of the host device 1 was taken as an example. When three or more target devices 2 have responded, the first assigned UID1 is assigned to the first target device 2, without alteration. The UID2 is assigned to the second target device 2, and a UID3 is assigned to the third target device 2. That is, when n target devices have responded, the UID reassignment is performed on (n−1) target devices.

Next, a format of the identifier reassignment signal to be used in the present embodiment will be described.

Figure 9:
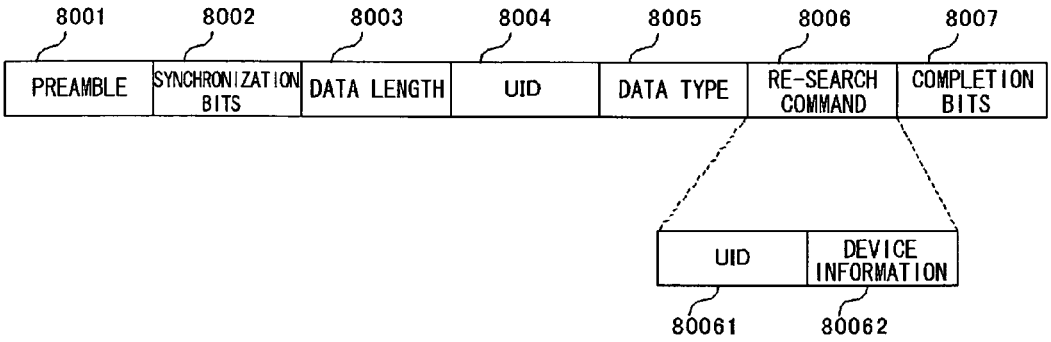
FIG. 9 is a diagram showing an example of a format of an identifier reassignment signal.

Referring to FIG. 9, an example of the format of the identifier reassignment signal is constituted from a preamble 8001, synchronization bits 8002, a data length 8003, a UID 8004, a data type 8005, a re-search command 8006, and completion bits 8007, each of which except the re-search command 8006 is constituted by the predetermined number of bits. The preamble 8001, synchronization bits 8002, data length 8003, UID 8004, data type 8005, and completion bits 8007 are the same as those described with reference to FIG. 4. A new UID 80061 to be reassigned and device information 80062 are set in the re-search command 8006.

As described above, according to the present embodiment, the same effect as that in the first embodiment can be obtained. Together with this, even when a plurality of the target devices 2 respond to the target device search signal transmitted through the directional antenna 142, the user can select a desired one of the target devices 2, for remote operation.

Next, a variation example of the present embodiment will be described.

In the present embodiment, after transmitting the target device search signal through the directional antenna 142, the host device 1 switches the antenna to the omni-directional antenna 143, through which the response signals from the target devices are received. Switching from the directional antenna 142 to the omni-directional antenna 143 may be performed after reception of the response signals from the target devices to the identifier reassignment signal, and the response signals from the target devices may be received through the directional antenna 142.

Third Embodiment

Figure 10:
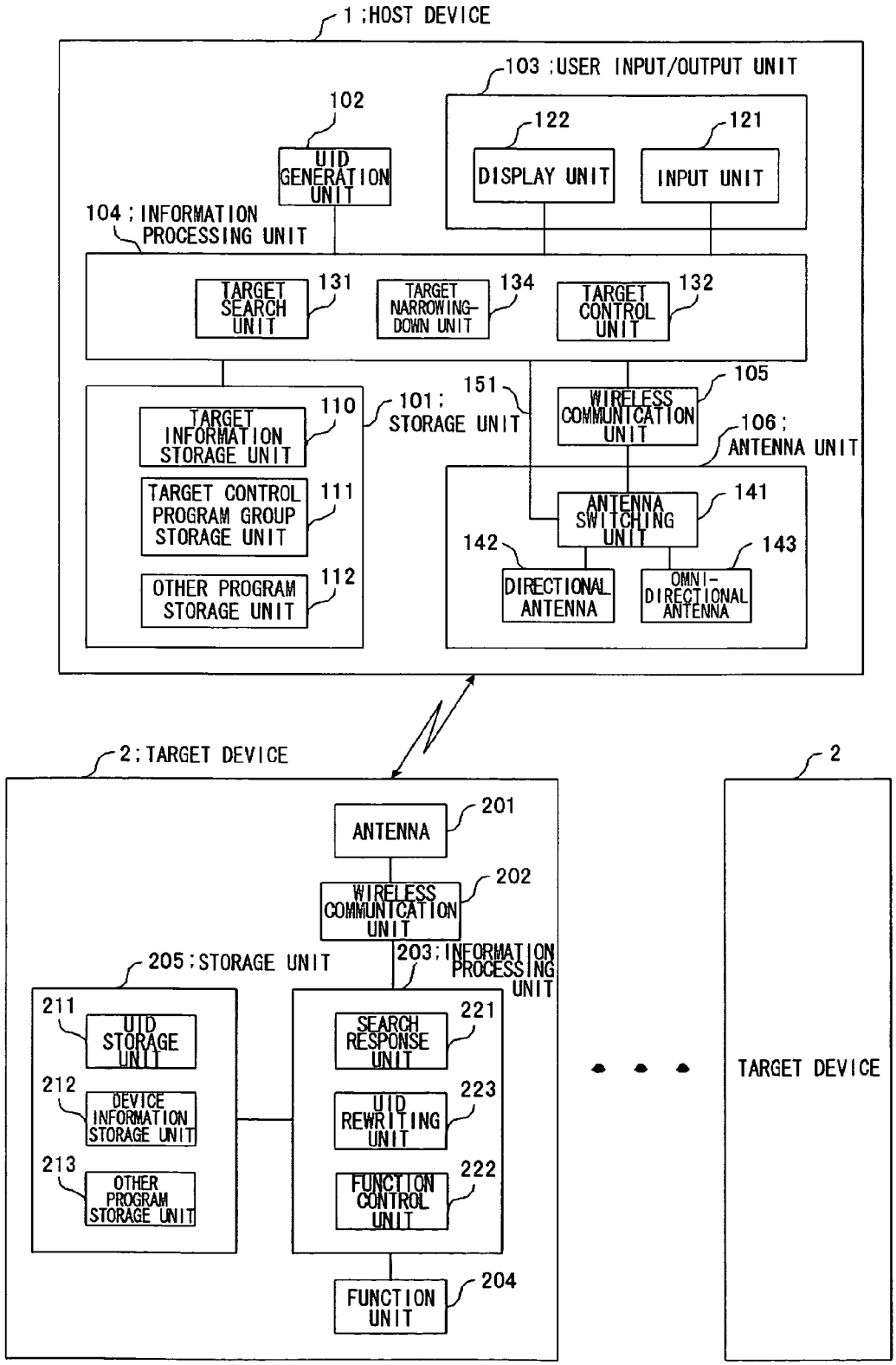
FIG. 10 is a block diagram showing a third embodiment of the present invention.

Referring to FIG. 10, a remote control system according to a third embodiment of the present invention is different from the remote control system in the second embodiment shown in FIG. 7 in that the information processing unit 104 of the host device 1 includes a target narrowing-down unit 134 in place of the target separating unit 133.

The target narrowing-down unit 134 takes over the processing from the target search unit 131 when the response signals to the target device search signal transmitted from the target search unit 131 are returned from a plurality of the target devices 2. First, the target narrowing-down unit 134 displays on the display unit 122*a* a list of the plurality of the target devices 2 that have transmitted the response signals, thereby causing the user to select one of the target devices 2 using an input from the input unit 121. Next, the target narrowing-down unit 134 transmits the identifier reassignment signal including a unique identifier newly generated by the UID generation unit 102 and the device information included in a corresponding one of the response signals, thereby performing identifier reassignment. The target control unit 132 performs the processing described before on this selected target device 2.

Next, an operation in the present embodiment when the user selectively performs remote operation of one of the plurality of the target devices 2 using the host device 1 will be described with reference to FIG. 11.

Figure 11:
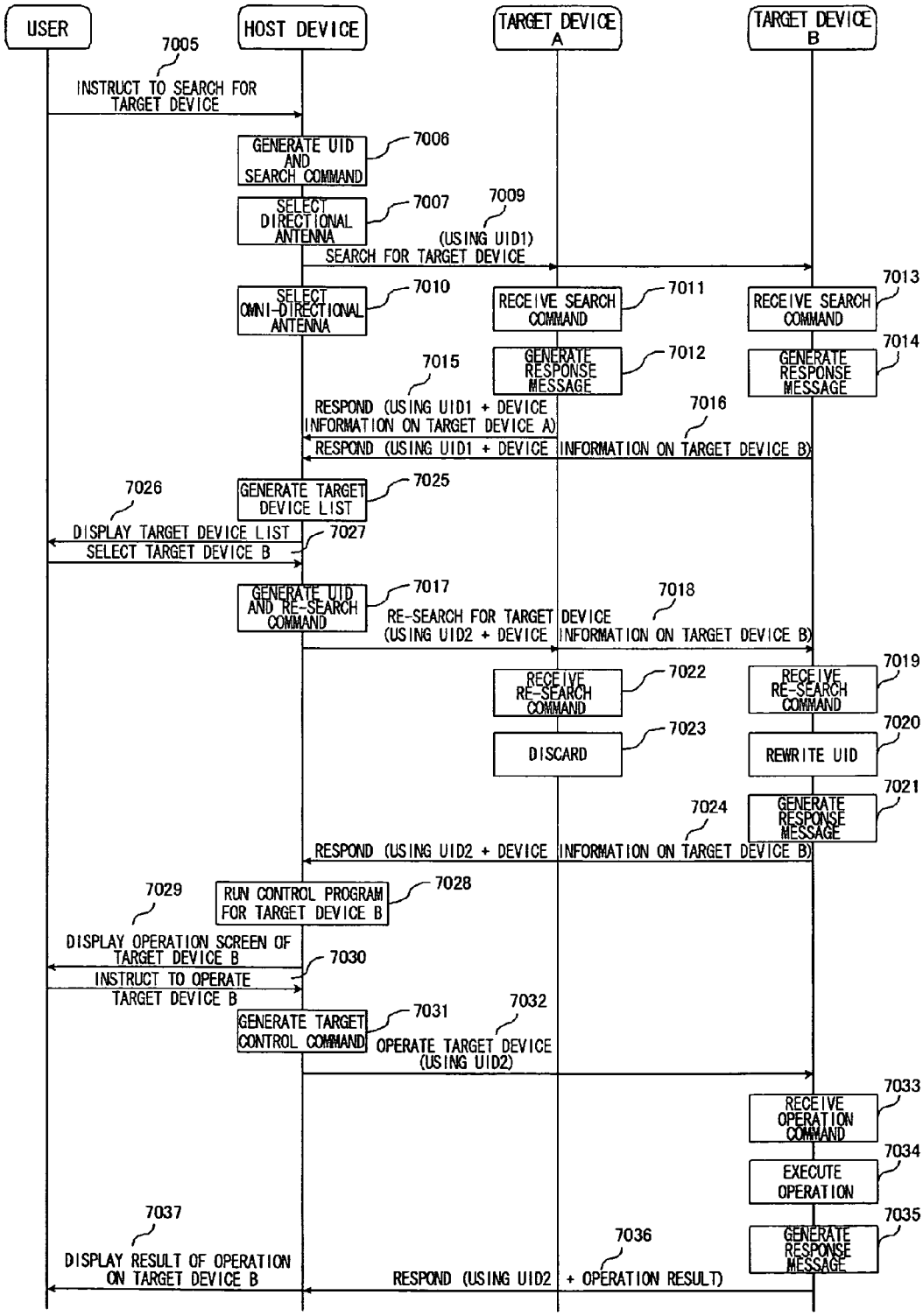
FIG. 11 is a diagram showing an operation sequence in the third embodiment of the present invention.

Operations after the user has operated the input unit 121 to input the instruction for searching for the target device and then the response signals from the target devices A and B return are the same as those in the second embodiment shown in FIG. 11 (steps 7005 to 7016). In the case of the present embodiment, as will be described below, operations at steps 7025 to 7027 in FIG. 11 are executed before operations at steps 7017 to 7024 in FIG. 11.

When the target narrowing-down unit 134 takes over the processing from the target search unit 131, the target narrowing-down unit 134 generates a list of the target devices including all or part of the device information included in the response messages (at step 7025), and displays the list on the display unit 122 (at step 7026). The user selects one of the target devices 2 currently desired to be operated from the list through the operation on the input unit 121 (at step 7027). It is assumed that in this current case, the user has selected the target device B.

When the target device B is selected by the user, the target narrowing-down unit 134 performs reassignment of the unique identifier to the selected target device B. That is, the target narrowing-down unit 134 generates the new identifier UID2 by the UID generation unit 102 and also generates the re-research command by itself (at step 7017). The target narrowing-down unit emits the identifier reassignment signal including the generated identifier UID2, device information on the target device B, and re-search command from the omni-directional antenna 143 through the wireless communication unit 105 (at step 7018).

In the target device B that has received the identifier reassignment signal, the identifier reassignment signal received at the antenna 201 is sent to the information processing unit 203 through the wireless communication unit 202, and is given to the UID rewriting unit 223 (at step 7019). Since the device information included in the identifier reassignment signal matches with the device information on the target device B stored in the device information memory unit 212, the UID rewriting unit 223 updates the UID memory unit 211 with the UID2 included in the identifier reassignment signal (at step 7020). Then, the target device B generates a response message including the reassigned UID2 and the device information on the target device B (at step 7021), and transmits the response message to the host device 1 through the wireless communication unit 202 (at step 7022). On the other hand, in the target device A that has received the identifier reassignment signal, the identifier reassignment signal received at the antenna 201 is given to the UID rewriting unit 223 of the information processing unit 203 through the wireless communication unit 202 (at step 7022). Incoincidence of the device information included in the identifier reassignment signal and the device information on the target device A stored in the device information memory unit 212 is detected by the UID rewriting unit 223, so that the identifier reassignment signal is discarded (at step 7023). As a result, the UID1 is kept assigned to the target device A, and the UID2 is reassigned to the target device B in place of the UID1. Thereafter, the target narrowing-down unit 134 transmits the reassigned UID2 of the target device B and the device information on the target device B to the target control unit 132. Subsequently, the same operations as those in the second embodiment are performed by the target control unit 132 (at steps 7028 to 7037).

In a manner described above, the user can selectively remote control one of the plurality of the target devices 2 using the host device 1.

In the foregoing description about the operation, a case where the two target devices 2 have responded to the target device search signal transmitted from the directional antenna 142 of the host device 1 was taken as an example. When three or more target devices 2 have responded as well, the operation is the same, and reassignment of the UID is performed on one of the target devices 2 selected by the user.

As described above, according to the present embodiment, the same effect as that in the first embodiment can be obtained. Together with this, even when a plurality of the target devices 2 respond to the target device search signal transmitted through the directional antenna 142, the user can select a desired one of the target devices 2, for remote operation.

Next, a variation example of the present embodiment will be described.

In the present embodiment, after transmitting the target device search signal through the directional antenna 142, the host device 1 switches the antenna to the omni-directional antenna 143, through which the response signals from the target devices are received. Switching from the directional antenna 142 to the omni-directional antenna 143 may be performed after reception of the response signals from the target devices to the identifier reassignment signal, and the response signals from the target devices may be received through the directional antenna 142.

Fourth Embodiment

Figure 12:
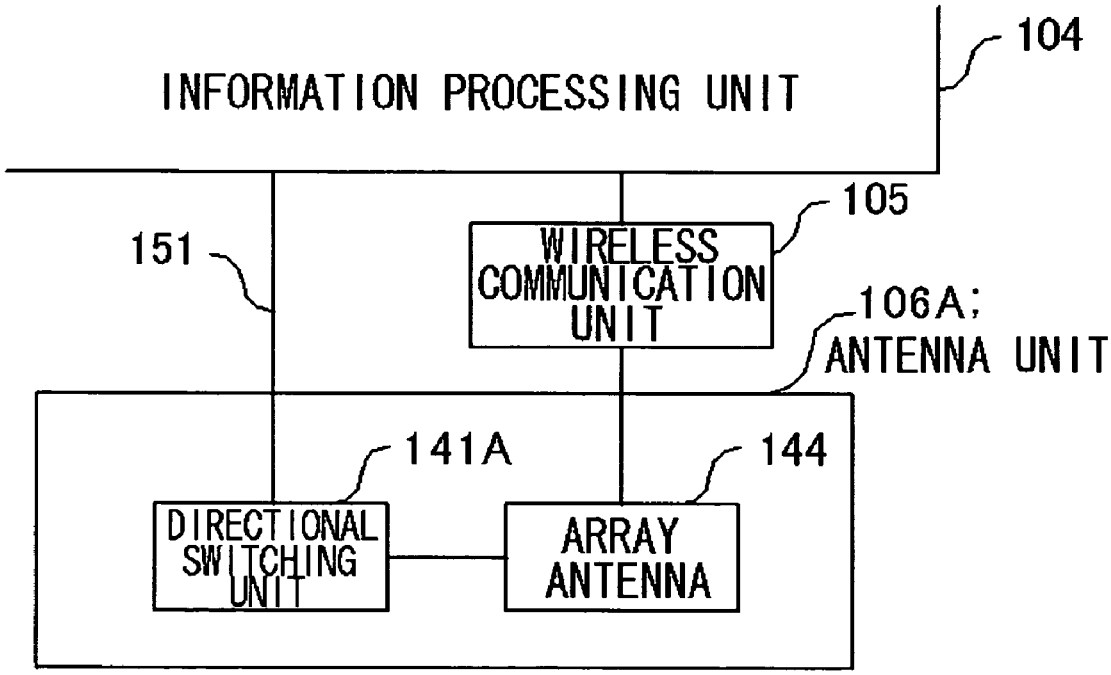
FIG. 12 is a block diagram showing a pertinent portion of a fourth embodiment of the present invention.

Referring to FIG. 12, a remote control system according to a fourth embodiment of the present invention is different in that in place of the antenna unit 106 included in the host device 1 in the remote control system according to the first, second, or third embodiment, an antenna unit 106A is included.

The antenna unit 106A is constituted from an array antenna 144 and a directivity switching unit 141A. The array antenna 144 is constituted from a plurality of antenna elements. By changing characteristics of each of the antenna element, characteristics of the antenna can be switched to the same characteristics as those of the directional antenna 142, or can be switched to the same characteristics as those of the omni-directional antenna 143. The directivity switching unit 141 switches the antenna characteristics of the array antenna 144 to the characteristics of the directional antenna or the characteristics of the omni-directional antenna, according to the antenna switching signal 151 transmitted from the information processing unit 104.

Fifth Embodiment

Figure 13:
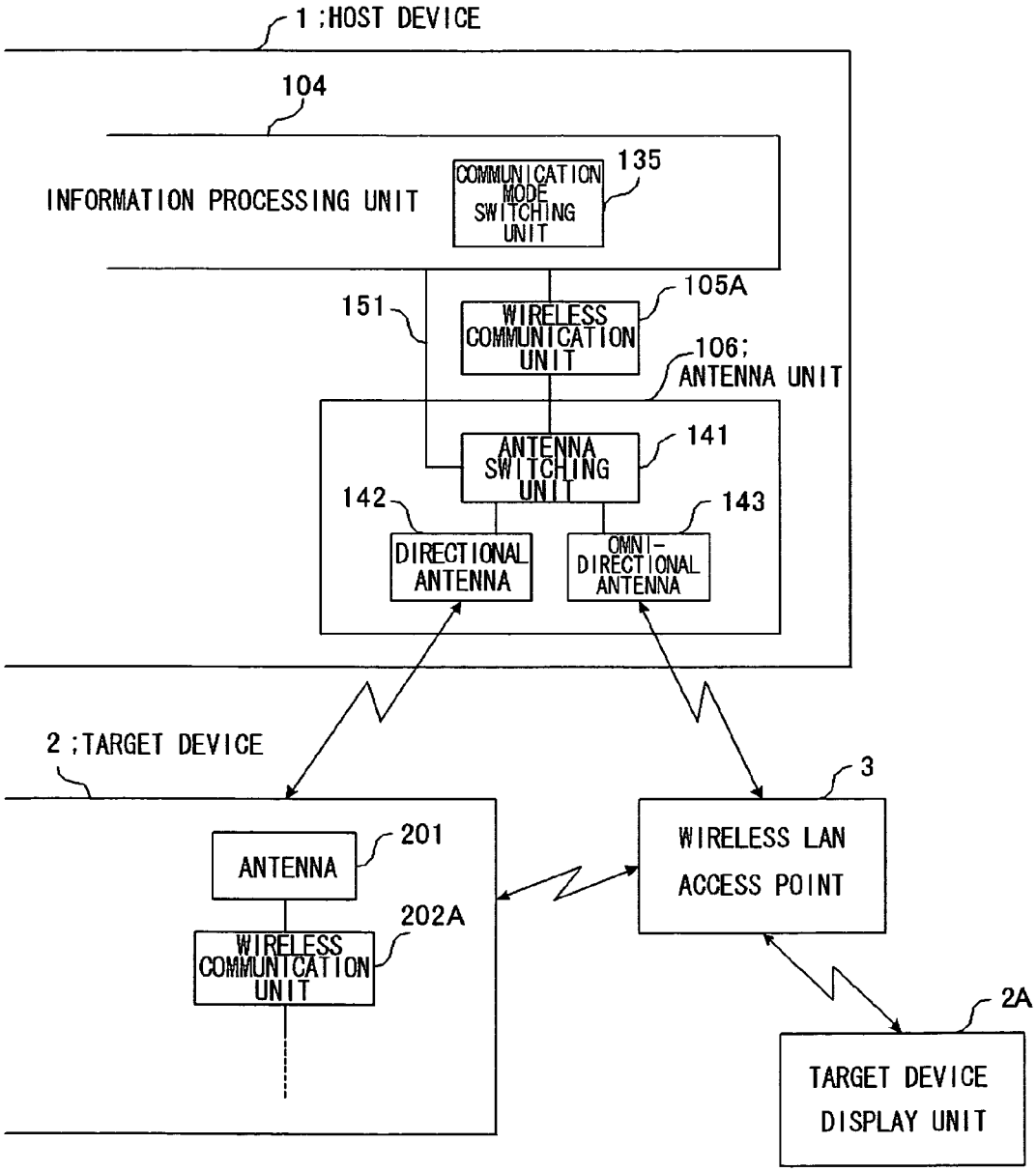
FIG. 13 is a block diagram showing a pertinent portion of a fifth embodiment of the present invention.

Referring to FIG. 13, a remote control system according to a fifth embodiment of the present invention is different from the remote control system according to the first, second, or third embodiment in that transmission of the remote control signal from the host device 1 to a target device 2 using the omni-directional antenna 143 is performed through a wireless LAN access point 3, which is a wireless relay station.

In the present embodiment, a wireless communication unit 202A of the target device 2 can perform simultaneous communication in an ad hoc mode and an infra mode (mode of belonging to the access point) of a wireless LAN. A wireless communication unit 105A of the host device 1 has the ad hoc mode and the infra mode of the wireless LAN. A communication mode switching unit 135 is provided in the information processing unit 104. The communication mode switching unit 135 has a function of performing switching of the wireless communication unit 105A between the ad hoc mode and the infra mode of the wireless LAN. Specifically, at a timing when switching to the omni-directional antenna 143 is performed by the antenna switching unit 141 using the antenna switching signal 151 during a period of transition from completion of specification of the target device to the state of performing an operation on the target device, the wireless communication unit 105A is switched from the ad hoc mode to the infra mode by the communication mode switching unit 135. In other words, the host device 1 has a function of setting the communication mode of the wireless LAN to the ad hoc mode and selecting the directional antenna 142 when selecting the target device 2. Then, when operating the target device 2, the host device 1 has a function of setting the communication mode of the wireless LAN to the infra mode and selecting the omni-directional antenna 143.

A display unit 2A of the target device 2 is configured to set in a different location, being separated from a main body of the target device and perform display by transmitting a display signal from the main body of the target device 2 to the display unit 2A through the wireless LAN access point 3. When the target device 2 is the TV receiver, for example, the main body of the target device is equivalent to a device in which a tuner and the like are contained, and the display unit 2A corresponds to a display panel. In a case of the target device 2 described above, the user specifies the target device to be operated relative to the main body of the target device, using the directional antenna 142. Thereafter, in a state where the user has moved to a location in which the display unit 2A of the target device is present, the user can use the omni-directional antenna 143 and can remote control the target device 2 through the wireless LAN access point 3.

The foregoing description was directed to the embodiments of the present invention. The present invention, however, is not limited to examples described above, and other various additions and modifications are possible. Further, function units such as the UID generation unit, target search unit, target control unit, target separating unit, target narrowing-down unit, communication mode switching unit, wireless communication unit, antenna switching unit, and directivity switching unit, included in the host device 1 constituting the remote control device of the present invention can be of course implemented by hardware. The function units can also be implemented by a computer and a host program. The host program is provided after being recorded on a recording medium that can be read by the computer, such as a magnetic disk or a semiconductor memory. Then, at a time of booting up the computer or the like, the host program is read by the computer. Then, the host program controls operations of the computer, thereby causing the computer to function as the respective function units described before. Likewise, the function units such as the search response unit, function control unit, UID rewriting unit, and wireless communication unit included in the target device 2 constituting a remote-controlled device of the present invention can be of course implemented by hardware. The function units of the target device 2 can also be implemented by a computer and a target program. The target program is provided after being recorded on a recording medium that can be read by the computer, such as the magnetic disk or the semiconductor memory. Then, at the time of booting up the computer or the like, the target program is read by the computer. Then, the target program controls operations of the computer, thereby causing the computer to function as the respective function units described before.

It should be noted that other objects, features and aspects of the present invention will become apparent in the entire disclosure and that modifications may be done without departing the gist and scope of the present invention as disclosed herein and claimed as appended herewith.

Also it should be noted that any combination of the disclosed and/or claimed elements, matters and/or items may fall under the modifications aforementioned.

What is claimed is:

1. A remote control system including a remote control device and one or more controlled target devices, wherein said remote control device comprises:

an antenna unit for being switched between a directional antenna and an omni-directional antenna;

a wireless communication unit connected to said antenna unit;

a user input/output unit;

a target search unit, responsive to a target search instruction input from said user input/output unit, for transmitting a search signal including a unique identifier through said wireless communication unit with said antenna unit switched to said directional antenna and for identifying one of said one or more controlled target devices based on a response signal including the identifier and device information received at said wireless communication unit; and a target control unit for transmitting a remote control signal including the identifier, for remote controlling said identified one of said one or more devices, through said wireless communication unit with said antenna unit switched to said omni-directional antenna; and wherein each of said one or more controlled target devices comprises:

an antenna;

a wireless communication unit connected to the antenna;

a device information memory unit for storing the device information on said each of said one or more controlled target devices;

an identifier memory unit for storing the identifier assigned to said each of said one or more controlled target devices;

a search response unit for storing the identifier included in the search signal in the identifier memory unit, when the search signal transmitted from said remote control device is received by the wireless communication unit, and for transmitting the response signal including the identifier and the device information stored in the device information memory unit to said remote control device through the wireless communication unit; and a function control unit for comparing the identifier included in the remote control signal with the identifier stored in the identifier memory unit when the remote control signal transmitted from said remote control device is received by the wireless communication unit, and for executing processing specified by the remote control signal when coincidence of the identifiers is detected.

2. The remote control system according to claim 1, wherein said remote control device further comprises:

a target separating unit for transmitting an identifier reassignment signal including a newly generated identifier and the device information included in the response signal to each of said one or more controlled target devices except one controlled target device, to perform identifier reassignment, when the response signal to the search signal transmitted from said target search unit is transmitted from each of the plurality of said one or more controlled target devices, displaying on said user input/output unit a list of the plurality of said one or more controlled target devices with different identifiers respectively assigned thereto, and for identifying one of the plurality of said one or more controlled target devices by an input from said user input/output unit; and wherein said each of said one or more controlled target devices further comprises an identifier rewriting unit for comparing the device information included in the identifier reassignment signal with the device information stored in the device information memory unit, when the identifier reassignment signal transmitted from said remote control device is received by the wireless communication unit, and for updating the identifier memory unit with the new identifier included in the identifier reassignment signal, when coincidence of the device information is detected.

3. The remote control system according to claim 1, wherein said remote control device further comprises:

a target narrowing-down unit for displaying on said user input/output unit a list of a plurality of said one or more controlled target devices, each having transmitted the response signal, when the response signal to the search signal transmitted from said target search unit is transmitted from said each of the plurality of said one or more controlled target devices, locating one of the plurality of said one or more controlled target devices, by an input from said user input/output unit, and for transmitting an identifier reassignment signal including a newly generated identifier and the device information included in the response signal to said identified one of the plurality of said one or more controlled target devices, thereby performing identifier reassignment; and wherein said each of said one or more controlled target devices further comprises an identifier rewriting unit for comparing the device information included in the identifier reassignment signal with the device information stored in the device information memory unit, when the identifier reassignment signal transmitted from said remote control device is received by the wireless communication unit, and for updating the identifier memory unit with the new identifier included in the identifier reassignment signal, when coincidence of the device information is detected.

4. The remote control system according to claim 1, wherein said antenna unit includes:

said directional antenna;

said omni-directional antenna; and an antenna switching unit for switching connection between said directional antenna and said wireless communication unit and connection between said omni-directional antenna and said wireless communication unit.

5. The remote control system according to claim 1, wherein said antenna unit includes:

an array antenna performing switching of antenna characteristics between antenna characteristics comparable to antenna characteristics of said directional antenna and antenna characteristics comparable to antenna characteristics of said onmi-directional antenna; and a directivity switching unit for switching the antenna characteristics of said array antenna.

6. The remote control system according to claim 1, wherein transmission of the remote control signal to said one or more controlled target devices from said remote control device using said omni-directional antenna is performed through a wireless relay station.

7. A method of remote controlling controlled target devices using a remote control device, said remote control device comprising: an antenna unit for being switched between a directional antenna and an omni-directional antenna; a wireless communication unit connected to said antenna unit, and a user input/output unit, each of said controlled target devices comprising: an antenna, a wireless communication unit connected to the antenna, a device information memory unit for storing device information on said each of said controlled target devices, and an identifier memory unit for storing an identifier assigned to said each of said controlled target devices, said method comprising:

responsive to a target search instruction input from said user input/output unit, transmitting, by a target search unit of said remote control device, a search signal including the unique identifier through said wireless communication unit of said remote control device with said antenna unit switched to said directional antenna;

storing the identifier included in the search signal in the identifier memory unit and transmitting a response signal including the identifier and the device information stored in the device information memory unit to said remote control device through the wireless communication unit by a search response unit of each of said controlled target devices that have received the search signal;

locating one of said controlled target devices, by said target search unit of said remote control device, based on the response signal including identifier and the device information received at said wireless communication unit of said remote control device;

transmitting a remote control signal including the identifier, for remote controlling said identified one of said controlled target devices, through said wireless communication unit of said remote control device with said antenna unit switched to said omni-directional antenna, by a target control unit of said remote control device; and comparing the identifier included in the remote control signal with the identifier stored in the identifier memory unit and executing processing specified by the remote control signal when coincidence of the identifiers is detected, by a function control unit of said identified one of said controlled target devices that has received the remote control signal.

8. A method of remote controlling controlled target devices using a remote control device, said remote control device comprising an antenna unit for being switched between a directional antenna and an omni-directional antenna, a wireless communication unit connected to said antenna unit, and a user input/output unit, each of said controlled target devices comprising an antenna, a wireless communication unit connected to the antenna, a device information memory unit for storing device information on said each of said controlled target devices, and an identifier memory unit for storing an identifier assigned to said each of said controlled target devices, said method comprising:

responsive to a target search instruction input from said user input/output unit, transmitting, by a target search unit of said remote control device, a search signal including the unique identifier through said wireless communication unit of said remote control device with said antenna unit switched to said directional antenna;

storing the identifier included in the search signal in the identifier memory unit and transmitting a response signal including the identifier and the device information stored in the device information memory unit to said remote control device through the wireless communication unit, by a search response unit of each of said controlled target devices that have received the search signal;

transmitting, by a target separating unit of said remote control device, an identifier reassignment signal including a newly generated identifier and the device information included in the response signal toward each of the plurality of said controlled target devices except one controlled target device, when the response signal to the search signal transmitted from said target search unit is transmitted from said each of the plurality of said controlled target devices;

comparing the device information included in the identifier reassignment signal with the device information stored in the device information memory unit and updating the identifier memory unit with the new identifier included in the identifier reassignment signal, when coincidence of the device information is detected, by an identifier rewriting unit of each of the plurality of said controlled target devices that have received the identifier reassignment signals, respectively;

displaying on said user input/output unit a list of the plurality of said controlled target devices with different identifiers assigned thereto and locating one of the plurality of said controlled target devices by an input from said user input/output unit by said target separating unit of said remote control device;

transmitting a remote control signal including the identifier, for remote controlling said identified one of the plurality of said controlled target devices, through said wireless communication unit of said remote control device with said antenna unit switched to said omni-directional antenna, by a target control unit of said remote control device; and comparing the identifier included in the remote control signal with the identifier stored in the identifier memory unit and executing processing specified by the remote control signal when coincidence of the identifiers is detected, by a function control unit of said identified one of the plurality of said controlled target devices that has received the remote control signal.

9. A method of remote controlling controlled target devices using a remote control device, said remote control device comprising an antenna unit for being switched between a directional antenna and an omni-directional antenna, a wireless communication unit connected to said antenna unit, and a user input/output unit, each of said controlled target devices comprising an antenna, a wireless communication unit connected to the antenna, a device information memory unit for storing device information on said each of said controlled target devices, and an identifier memory unit for storing an identifier assigned to said each of said controlled target devices, said method comprising:

responsive to a target search instruction input from said user input/output unit, transmitting, by a target search unit of said remote control device, a search signal including a unique identifier through said wireless communication unit of said remote control device with said antenna unit switched to said directional antenna;

storing the identifier included in the search signal in the identifier memory unit and transmitting a response signal including the identifier and the device information stored in the device information memory unit to said remote control device through the wireless communication unit, by a search response unit of each of said controlled target devices that have received the search signal;

displaying on said user input/output unit a list of a plurality of said controlled target devices each having transmitted the response signal, when the response signal to the search signal transmitted from said target search unit is transmitted from each of the plurality of the controlled target devices, locating one of the plurality of said controlled target devices by an input from said user input/output unit, and transmitting an identifier reassignment signal including a newly generated identifier and the device information included in the response signal toward said identified one of the plurality of said devices, by a target narrowing-down unit of said remote control device;

comparing the device information included in the identifier reassignment signal with the device information stored in the device information memory unit and updating the identifier memory unit with the new identifier included in the identifier reassignment signal, when coincidence of the device information is detected, by an identifier rewriting unit of each of the plurality of said controlled target devices that have received the identifier reassignment signal;

transmitting a remote control signal including the reassigned identifier, for remote controlling said identified one of the plurality of said controlled target devices, through said wireless communication unit of said remote control device with said antenna unit switched to said omni-directional antenna, by a target control unit of said remote control device; and comparing the identifier included in the remote control signal with the identifier stored in the identifier memory unit and executing processing specified by the remote control signal when coincidence of the identifiers is detected, by a function control unit of said identified one of the plurality of said controlled target devices that has received the remote control signal.

10. A remote control device comprising:

an antenna unit for being switched between a directional antenna and an omni-directional antenna;

a wireless communication unit connected to said antenna unit;

a user input/output unit;

a target search unit responsive to a target search instruction input from said user input/output unit for transmitting a search signal including a unique identifier to controlled target devices through said wireless communication unit with said antenna unit switched to said directional antenna, and for identifying one of said controlled target devices based on a response signal received at said wireless communication unit, said response signal including the identifier and device information; and a target control unit for transmitting a remote control signal including the identifier, for remote controlling said identified one of said controlled target devices, through said wireless communication unit with said antenna unit switched to said omni-directional antenna.

11. The remote control device according to claim 10, further comprising:

a target separating unit for transmitting an identifier reassignment signal including a newly generated identifier and the device information included in the response signal to each of a plurality of said controlled target devices except one controlled target device, to perform identifier reassignment when the response signal to the search signal transmitted from said target search unit is transmitted from each of the plurality of said controlled target devices, displaying on said user input/output unit a list of the plurality of said controlled target devices with different identifiers assigned thereto, and for identifying one of the plurality of said controlled target devices by an input from said user input/output unit.

12. The remote control device according to claim 10, further comprising:

a target narrowing-down unit for displaying on said user input/output unit a list of a plurality of said controlled target devices each having transmitted the response signal when the response signal to the search signal transmitted from said target search unit is transmitted from each of the plurality of said controlled target devices, locating one of the plurality of said controlled target devices by an input from said user input/output unit, and for transmitting an identifier reassignment signal including a newly generated identifier and the device information included in the response signal toward said identified one of the plurality of said controlled target devices, thereby performing identifier reassignment.

13. A controlled target device comprising:

an antenna;

a wireless communication unit connected to said antenna;

a device information memory unit for storing device information on said controlled target device;

an identifier memory unit for storing a unique identifier assigned to said controlled target device by a remote control device;

a search response unit for storing the unique identifier included in a search signal, in said identifier memory unit, when the search signal including the unique identifier transmitted from said remote control device is received at said wireless communication unit, and for transmitting a response signal including the unique identifier and the device information stored in said device information memory unit to said remote control device through said wireless communication unit; and a function control unit for comparing the identifier included in a remote control signal from said remote control device with the unique identifier stored in said identifier memory unit when the remote control signal transmitted from said remote control device is received at said wireless communication unit, and for executing processing specified by the remote control signal, when coincidence of the identifier transmitted from said remote control device with the unique identifier stored in said identifier unit is detected.

14. The device according to claim 13, further comprising:

an identifier rewriting unit for comparing device information included in an identifier reassignment signal with the device information stored in said device information memory unit, when the identifier reassignment signal including a reassigned identifier and the device information transmitted from said remote control device is received at said wireless communication unit, and for updating said identifier memory unit with the reassigned identifier included in the identifier reassignment signal, when coincidence of the device information is detected.

15. A computer readable medium having stored thereon a program of computer executable instructions for causing a computer constituting a remote control device comprising an antenna unit for being switched between a directional antenna and an omni-directional antenna, a wireless communication unit connected to said antenna unit, and a user input/output units, to execute:

a target search processing, responsive to a target search instruction input from said user input/output unit, for transmitting a search signal including a unique identifier to controlled target devices through said wireless communication unit with said antenna unit switched to said directional antenna, and for identifying one of said controlled target devices based on a response signal including the identifier and device information received at said wireless communication unit; and a target control processing for transmitting a remote control signal including the identifier, for remote controlling said identified one of said devices, through said wireless communication unit with said antenna unit switched to said omni-directional antenna.

16. The computer readable medium having stored thereon a program of computer executable instructions according to claim 15, further causing said computer to execute:

a target separating processing for transmitting an identifier reassignment signal a newly generated identifier and the device information included in the response signal to each of a plurality of said controlled target devices except one controlled target device, to perform identifier reassignment, when the response signal to the search signal transmitted from said target search unit is transmitted from each of the plurality of said controlled target devices, displaying on said user input/output unit a list of the plurality of said controlled target devices with different identifiers respectively assigned thereto, and for identifying one of the plurality of said controlled target devices by an input from said user input/output unit.

17. The computer readable medium having stored thereon a program of computer executable instructions according to claim 15, further causing said computer to execute:

a target narrowing-down processing for displaying on said user input/output unit a list of a plurality of said controlled target devices each having transmitted the response signal when the response signal to the search signal transmitted from said target search unit is transmitted from said each of the plurality of said controlled target devices, locating one of the plurality of said controlled target devices by an input from said user input/output unit, and for transmitting an identifier reassignment signal including a newly generated identifier and the device information included in the response signal to said identified one of the plurality of said controlled target devices, thereby performing identifier reassignment.

18. A computer readable medium having stored thereon a program of computer executable instructions for causing a computer constituting a controlled target device comprising an antenna, a wireless communication unit connected to said antenna, a device information memory unit for storing device information on said controlled target device, and an identifier memory unit for storing an identifier assigned to said controlled target device, to execute:

a search response processing for storing the unique identifier included in a search signal in said identifier memory unit when the search signal including the unique identifier transmitted from a remote control device is received at said wireless communication unit, and for transmitting a response signal including the identifier and the device information stored in said device information memory unit to said remote control device through said wireless communication unit; and a function control processing for comparing the identifier included in the remote control signal with the identifier stored in said identifier memory unit when the remote control signal transmitted from said remote control device is received at said wireless communication unit, and for executing processing specified by the remote control signal when coincidence of the identifiers is detected.

19. The computer readable medium having stored thereon a program of computer executable instructions according to claim 18, further causing said computer to execute:

an identifier rewriting processing for comparing device information included in an identifier reassignment signal with the device information stored in said device information memory unit, when the identifier reassignment signal including a reassigned identifier and the device information transmitted from said remote control device is received at said wireless communication unit, and for updating said identifier memory unit with the reassigned identifier included in the identifier reassignment signal when coincidence of the device information is detected.

20. The remote control system according to claim 2, wherein said target separating unit transmits said identifier reassignment signal through said wireless communication unit with said antenna unit switched to said omni-directional antenna.

21. The remote control system according to claim 3, wherein said target narrow-down unit transmits said identifier reassignment signal through said wireless communication unit with said antenna unit switched to said omni-directional antenna.

* * * * *